US008620672B2

(12) United States Patent
Visser et al.

(10) Patent No.: US 8,620,672 B2
(45) Date of Patent: Dec. 31, 2013

(54) SYSTEMS, METHODS, APPARATUS, AND COMPUTER-READABLE MEDIA FOR PHASE-BASED PROCESSING OF MULTICHANNEL SIGNAL

(75) Inventors: Erik Visser, San Diego, CA (US); Ernan Liu, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 636 days.

(21) Appl. No.: 12/796,566

(22) Filed: Jun. 8, 2010

(65) Prior Publication Data

US 2010/0323652 A1 Dec. 23, 2010

Related U.S. Application Data

(60) Provisional application No. 61/185,518, filed on Jun. 9, 2009, provisional application No. 61/227,037, filed on Jul. 20, 2009, provisional application No. 61/240,318, filed on Sep. 8, 2009, provisional application No. 61/240,320, filed on Sep. 8, 2009.

(51) Int. Cl.
*G10L 19/00* (2013.01)

(52) U.S. Cl.
USPC ..... 704/500; 704/501; 704/503; 704/200; 704/226; 704/205

(58) Field of Classification Search
USPC ..... 704/500, 501, 503, 200, 205, 226
See application file for complete search history.

(56) References Cited

U.S. PATENT DOCUMENTS

| | | | | |
|---|---|---|---|---|
| 6,069,961 | A * | 5/2000 | Nakazawa | 381/92 |
| 6,272,229 | B1 * | 8/2001 | Baekgaard | 381/313 |
| 7,006,636 | B2 | 2/2006 | Baumgarte et al. | |
| 7,496,482 | B2 | 2/2009 | Araki et al. | |
| 2003/0147538 | A1 | 8/2003 | Elko | |
| 2003/0198356 | A1 * | 10/2003 | Thompson | 381/92 |
| 2006/0067541 | A1 * | 3/2006 | Yamada et al. | 381/98 |
| 2006/0106601 | A1 | 5/2006 | Kong et al. | |
| 2006/0215854 | A1 | 9/2006 | Suzuki et al. | |
| 2007/0160230 | A1 | 7/2007 | Nakagomi | |
| 2008/0170728 | A1 | 7/2008 | Faller | |
| 2008/0232607 | A1 | 9/2008 | Tashev et al. | |
| 2009/0089053 | A1 | 4/2009 | Wang et al. | |
| 2011/0038489 | A1 | 2/2011 | Visser et al. | |

FOREIGN PATENT DOCUMENTS

| | | | |
|---|---|---|---|
| EP | 1640973 | | 3/2006 |
| JP | 2002084590 | A | 3/2002 |
| JP | 2003078988 | A | 3/2003 |
| JP | 2007010897 | A | 1/2007 |
| JP | 2007068125 | A | 3/2007 |
| JP | 2007183202 | A | 7/2007 |
| JP | 2008079256 | A | 4/2008 |

(Continued)

OTHER PUBLICATIONS

International Preliminary Report on Patentability—PCT/US2010/037973, The International Bureau of WIPO—Geneva, Switzerland, Sep. 26, 2011.

International Search Report and Written Opinion—PCT/US2010/037973 , International Search Authority—European Patent Office—Aug. 18, 2010.

(Continued)

*Primary Examiner* — Qi Han

(74) *Attorney, Agent, or Firm* — Espartaco Diaz Hidalgo

(57) ABSTRACT

Phase-based processing of a multichannel signal, and applications including proximity detection, are disclosed.

39 Claims, 30 Drawing Sheets

(56) References Cited

FOREIGN PATENT DOCUMENTS

| | | | |
|---|---|---|---|
| KR | 19950035103 | | 12/1995 |
| KR | 20080092404 | A | 10/2008 |
| WO | 2005024788 | A1 | 3/2005 |
| WO | WO2009042385 | | 4/2009 |

OTHER PUBLICATIONS

Nagata Y et al., "Target Signal Detection System Using Two Directional Microphones," Transactions of the Institute of Electronics, Information and Communication Engineers, Dec. 2000, vol. J83-A, No. 12, pp. 1445-1454.

* cited by examiner

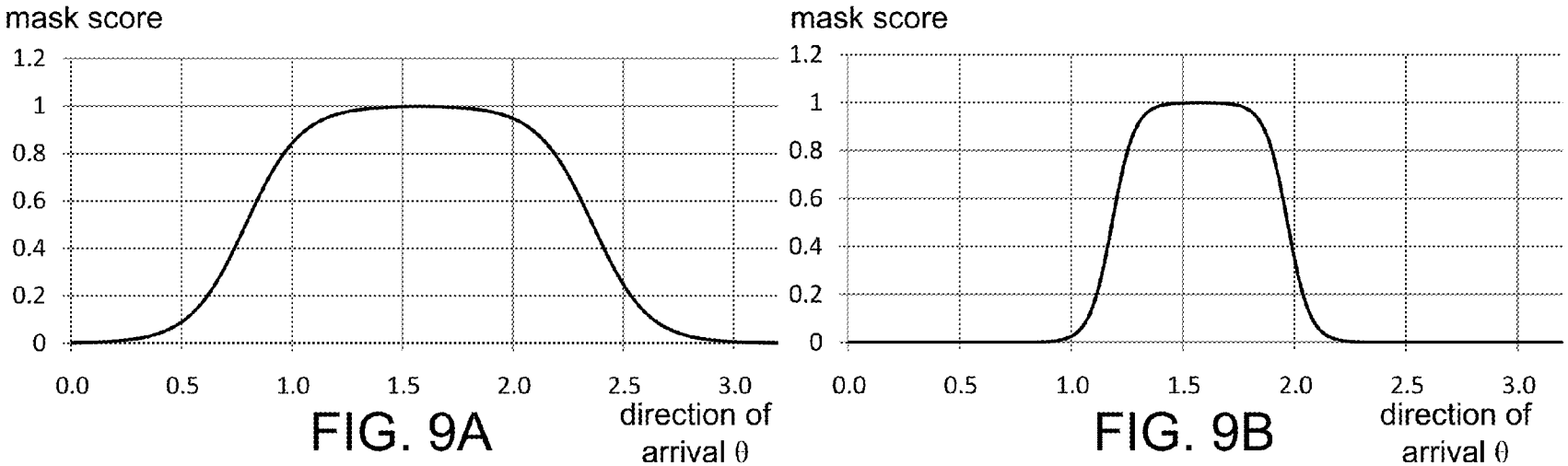
FIG. 9A
FIG. 9B
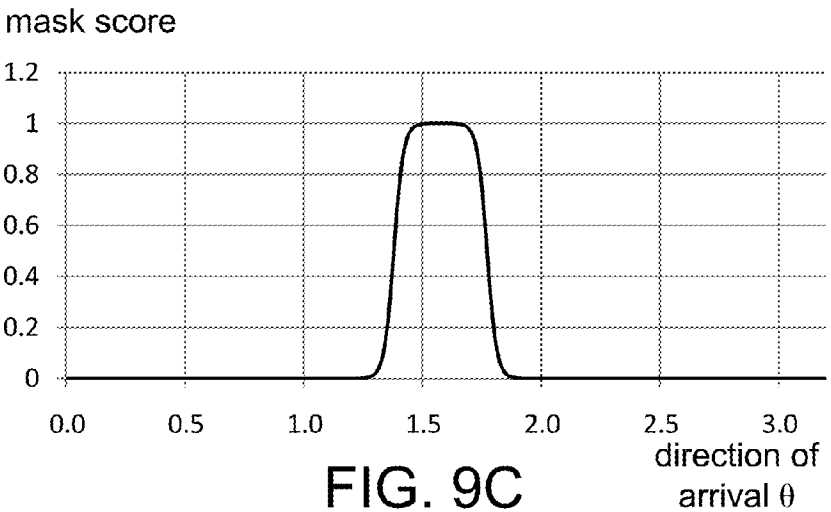
FIG. 9C

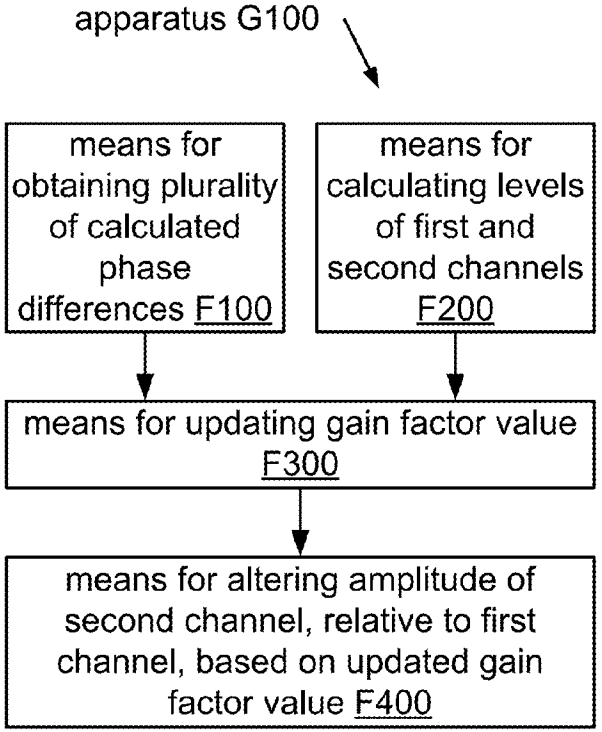
FIG. 20B
FIG. 20A
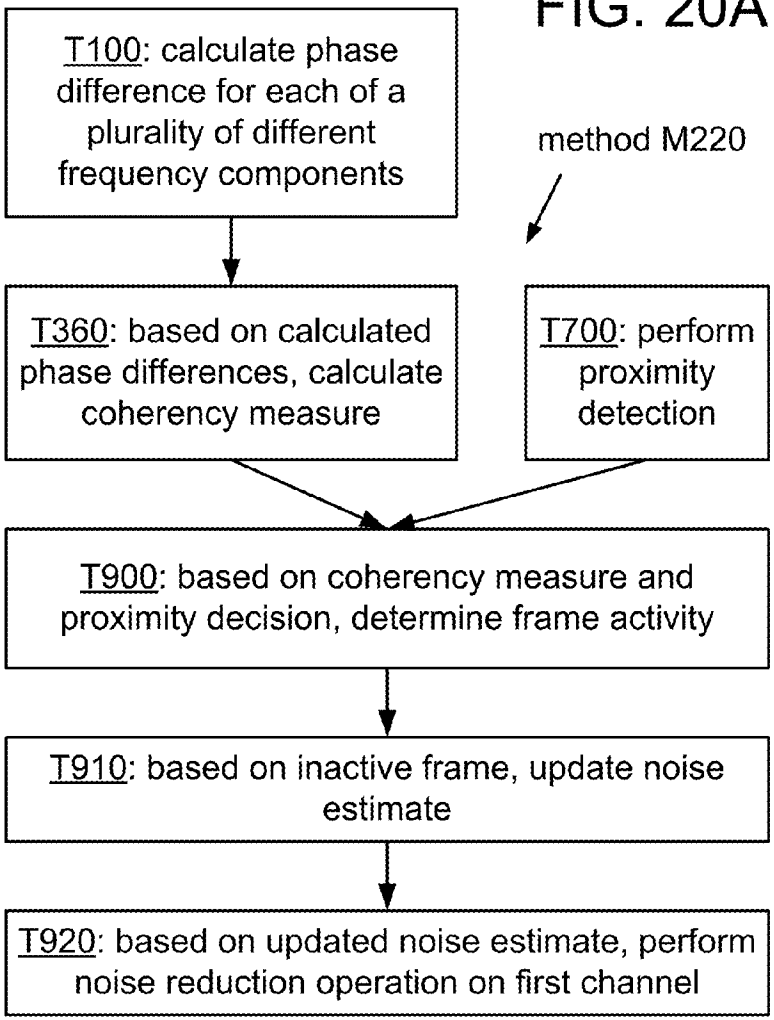

SYSTEMS, METHODS, APPARATUS, AND COMPUTER-READABLE MEDIA FOR PHASE-BASED PROCESSING OF MULTICHANNEL SIGNAL

CLAIM OF PRIORITY UNDER 35 U.S.C. §119

The present Application for Patent claims priority to U.S. Provisional Pat. Appl. No. 61/185,518, entitled "Systems, methods, apparatus, and computer-readable media for coherence detection," filed Jun. 9, 2009 and assigned to the assignee hereof. The present Application for Patent also claims priority to U.S. Provisional Pat. Appl. No. 61/240,318, entitled "Systems, methods, apparatus, and computer-readable media for coherence detection," filed Sep. 8, 2009 and assigned to the assignee hereof.

The present Application for Patent also claims priority to U.S. Provisional Pat. Appl. No. 61/227,037, entitled "Systems, methods, apparatus, and computer-readable media for phase-based processing of multichannel signal," filed Jul. 20, 2009 and assigned to the assignee hereof. The present Application for Patent also claims priority to U.S. Provisional Pat. Appl. No. 61/240,320, entitled "Systems, methods, apparatus, and computer-readable media for phase-based processing of multichannel signal," filed Sep. 8, 2009 and assigned to the assignee hereof.

BACKGROUND

1. Field

This disclosure relates to signal processing.

2. Background

Many activities that were previously performed in quiet office or home environments are being performed today in acoustically variable situations like a car, a street, or a café. For example, a person may desire to communicate with another person using a voice communication channel. The channel may be provided, for example, by a mobile wireless handset or headset, a walkie-talkie, a two-way radio, a car-kit, or another communications device. Consequently, a substantial amount of voice communication is taking place using mobile devices (e.g., smartphones, handsets, and/or headsets) in environments where users are surrounded by other people, with the kind of noise content that is typically encountered where people tend to gather. Such noise tends to distract or annoy a user at the far end of a telephone conversation. Moreover, many standard automated business transactions (e.g., account balance or stock quote checks) employ voice recognition based data inquiry, and the accuracy of these systems may be significantly impeded by interfering noise.

For applications in which communication occurs in noisy environments, it may be desirable to separate a desired speech signal from background noise. Noise may be defined as the combination of all signals interfering with or otherwise degrading the desired signal. Background noise may include numerous noise signals generated within the acoustic environment, such as background conversations of other people, as well as reflections and reverberation generated from the desired signal and/or any of the other signals. Unless the desired speech signal is separated from the background noise, it may be difficult to make reliable and efficient use of it. In one particular example, a speech signal is generated in a noisy environment, and speech processing methods are used to separate the speech signal from the environmental noise.

Noise encountered in a mobile environment may include a variety of different components, such as competing talkers, music, babble, street noise, and/or airport noise. As the signature of such noise is typically nonstationary and close to the user's own frequency signature, the noise may be hard to model using traditional single microphone or fixed beamforming type methods. Single microphone noise reduction techniques typically require significant parameter tuning to achieve optimal performance. For example, a suitable noise reference may not be directly available in such cases, and it may be necessary to derive a noise reference indirectly. Therefore multiple microphone based advanced signal processing may be desirable to support the use of mobile devices for voice communications in noisy environments.

SUMMARY

A method of processing a multichannel signal according to a general configuration includes, for each of a plurality of different frequency components of the multichannel signal, calculating a difference between a phase of the frequency component in a first channel of the multichannel signal and a phase of the frequency component in a second channel of the multichannel signal, to obtain a plurality of calculated phase differences. This method includes calculating a level of the first channel and a corresponding level of the second channel. This method includes calculating an updated value of a gain factor, based on the calculated level of the first channel, the calculated level of the second channel, and at least one of the plurality of calculated phase differences, and producing a processed multichannel signal by altering, according to the updated value, an amplitude of the second channel relative to a corresponding amplitude of the first channel. Apparatus that include means for performing each of these acts are also disclosed herein. Computer-readable media having tangible features that store machine-executable instructions for performing such a method are also disclosed herein.

An apparatus for processing a multichannel signal according to a general configuration includes a first calculator configured to obtain a plurality of calculated phase differences by calculating, for each of a plurality of different frequency components of the multichannel signal, a difference between a phase of the frequency component in a first channel of the multichannel signal and a phase of the frequency component in a second channel of the multichannel signal. This apparatus includes a second calculator configured to calculate a level of the first channel and a corresponding level of the second channel, and a third calculator configured to calculate an updated value of a gain factor, based on the calculated level of the first channel, the calculated level of the second channel, and at least one of the plurality of calculated phase differences. This apparatus includes a gain control element configured to produce a processed multichannel signal by altering, according to the updated value, an amplitude of the second channel relative to a corresponding amplitude of the first channel.

BRIEF DESCRIPTION OF THE DRAWINGS

FIGS. 9A-C show examples of a nonlinear function for different parameter values.

FIG. 20A shows a flowchart of an implementation M320 of method M310.

FIG. 20B shows a block diagram of an apparatus G100 according to a general configuration.

DETAILED DESCRIPTION

The real world abounds from multiple noise sources, including single point noise sources, which often transgress into multiple sounds resulting in reverberation. Background acoustic noise may include numerous noise signals generated by the general environment and interfering signals generated by background conversations of other people, as well as reflections and reverberation generated from a desired sound signal and/or any of the other signals.

Environmental noise may affect the intelligibility of a sensed audio signal, such as a near-end speech signal. It may be desirable to use signal processing to distinguish a desired audio signal from background noise. For applications in which communication may occur in a noisy environment, for example, it may be desirable to use a speech processing method to distinguish a speech signal from background noise and enhance its intelligibility. Such processing may be important in many areas of everyday communication, as noise is almost always present in real-world conditions.

It may be desirable to produce a portable audio sensing device that has an array R100 of two or more microphones configured to receive acoustic signals. Examples of a portable audio sensing device that may be implemented to include such an array and may be used for audio recording and/or voice communications applications include a telephone handset (e.g., a cellular telephone handset or smartphone); a wired or wireless headset (e.g., a Bluetooth headset); a handheld audio and/or video recorder; a personal media player configured to record audio and/or video content; a personal digital assistant (PDA) or other handheld computing device; and a notebook computer, laptop computer, netbook computer, or other portable computing device.

Figure 1:
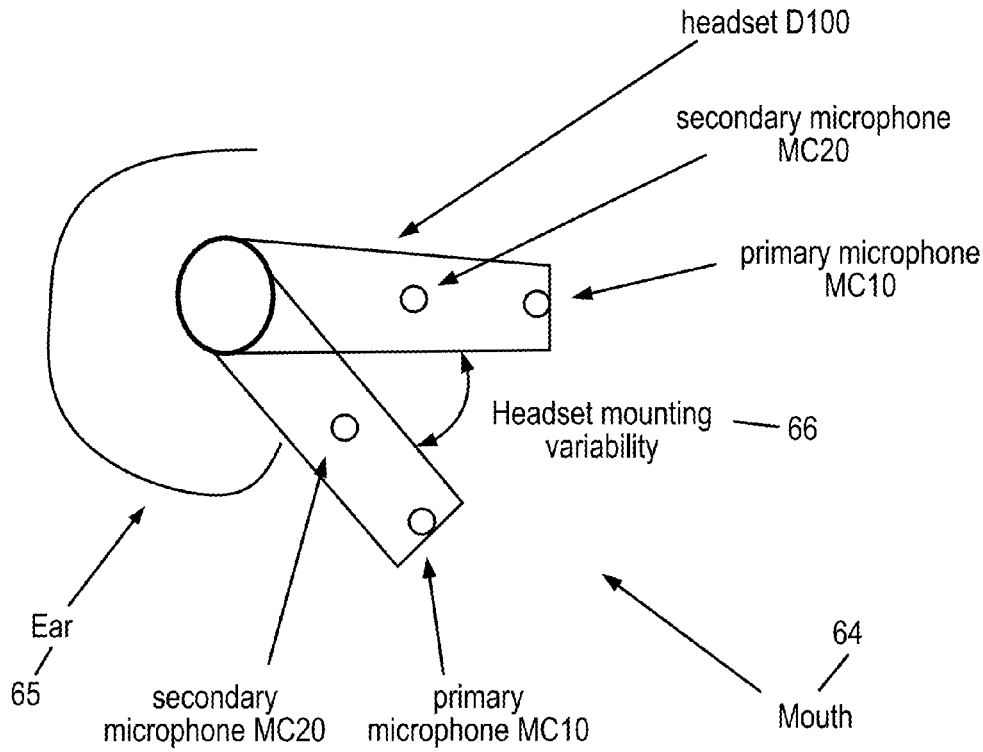
FIG. 1 shows a side view of a headset D100 in use.
Figure 2:
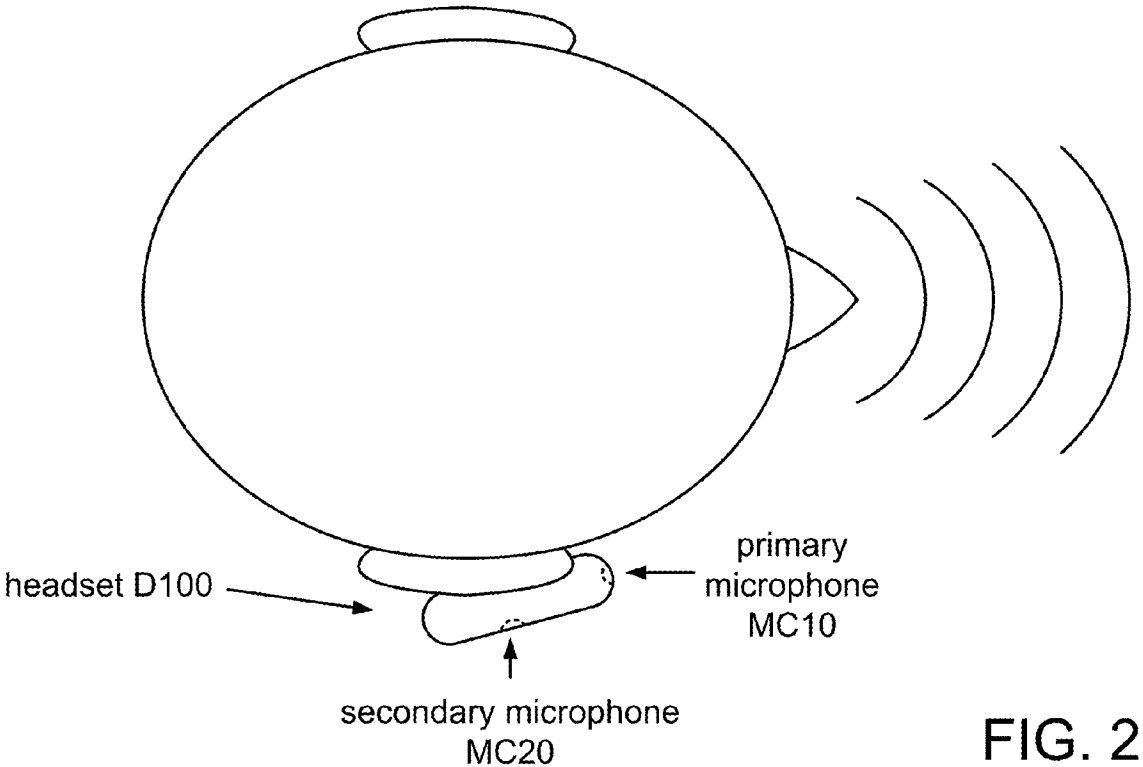
FIG. 2 shows a top view of headset D100 mounted on a user's ear.

During normal use, a portable audio sensing device may operate in any among a range of standard orientations relative to a desired sound source. For example, different users may wear or hold a device differently, and the same user may wear or hold a device differently at different times, even within the same period of use (e.g., during a single telephone call). FIG. 1 shows a side view of a headset D100 in use that includes two examples in a range of standard orientations of the device relative to the user's mouth. Headset D100 has an instance of array R100 that includes a primary microphone MC10, which is positioned to receive the user's voice more directly during a typical use of the device, and a secondary microphone MC20, which is positioned to receive the user's voice less directly during a typical use of the device. FIG. 2 shows a top view of headset D100 mounted on a user's ear in a standard orientation relative to the user's mouth. FIG. 3A shows a side view of a handset D300 in use that includes two examples in a range of standard orientations of the device relative to the user's mouth.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample (or "bin") of a frequency-domain representation of the signal (e.g., as produced by a fast Fourier transform) or a subband of the signal (e.g., a Bark scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The near-field may be defined as that region of space which is less than one wavelength away from a sound receiver (e.g., a microphone array). Under this definition, the distance to the boundary of the region varies inversely with frequency. At frequencies of two hundred, seven hundred, and two thousand hertz, for example, the distance to a one-wavelength boundary is about 170, forty-nine, and seventeen centimeters, respectively. It may be useful instead to consider the near-field/far-field boundary to be at a particular distance from the microphone array (e.g., fifty centimeters from a microphone of the array or from the centroid of the array, or one meter or 1.5 meters from a microphone of the array or from the centroid of the array).

A microphone array produces a multichannel signal in which each channel is based on the response of a corresponding one of the microphones to the acoustic environment. It may be desirable to perform a spatially selective processing (SSP) operation on the multichannel signal to discriminate between components of the signal that are received from different sources. For example, it may be desirable to discriminate between sound components from a desired source of directional sound (e.g., a user's mouth) and sound components from diffuse background noise and/or one or more sources of directional interfering noise (e.g., a competing speaker). Examples of SSP operations include beamforming approaches (e.g., generalized sidelobe cancellation (GSC), minimum variance distortionless response (MVDR), and/or linearly constrained minimum variance (LCMV) beamformers), blind source separation (BSS) and other adaptive learning approaches, and gain-based proximity detection. Typical applications of SSP operations include multi-microphone noise reduction schemes for portable audio sensing devices.

The performance of an operation on a multichannel signal produced by array R100, such as an SSP operation, may depend on how well the response characteristics of the array channels are matched to one another. For example, it is possible for the levels of the channels to differ due to a difference in the response characteristics of the respective microphones, a difference in the gain levels of respective preprocessing stages, and/or a difference in circuit noise levels of the channels. In such case, the resulting multichannel signal may not provide an accurate representation of the acoustic environment unless the mismatch between the channel response characteristics (also called a "channel response imbalance") may be compensated.

Without such compensation, an SSP operation based on such a signal may provide an erroneous result. For an operation in which gain differences between channels are used to indicate the relative proximity of a directional sound source, an imbalance between the responses of the channels will tend to reduce the accuracy of the proximity indication. In another example, amplitude response deviations between the channels as small as one or two decibels at low frequencies (i.e., approximately 100 Hz to 1 kHz) may significantly reduce low-frequency directionality. Effects of an imbalance among the responses of the channels of array R100 may be especially detrimental for applications processing a multichannel signal from an implementation of array R100 that has more than two microphones.

Accurate channel calibration may be especially important for headset applications. For example, it may be desirable to configure a portable audio sensing device to discriminate between sound components arriving from near-field sources and sound components arriving from far-field sources. Such discrimination may be performed on the basis of a difference between the gain levels of two channels of the multichannel signal (i.e., the "interchannel gain level difference"), as this difference can be expected to be higher for sound components from near-field sources located at an endfire direction of the array (i.e., near a line that passes through the centers of the corresponding microphones).

As the distance between the microphones decreases, the interchannel gain level difference for a near-field signal also decreases. For handheld applications, the interchannel gain level difference for near-field signals is typically about six decibels from the interchannel gain level difference for far-field signals. For headset applications, however, the interchannel gain level difference for a typical near-field sound component may be within three decibels (or even less) of the interchannel gain level difference for a typical far-field sound component. In such case, a channel response imbalance of only a few decibels may severely impede the ability to discriminate between such components, while an imbalance of three decibels or more may destroy it.

An imbalance between the responses of the array channels may arise from a difference between the responses of the microphones themselves. Variations may arise during manufacture of the microphones of array R100, such that even among a batch of mass-produced and apparently identical microphones, sensitivity may vary significantly from one microphone to another. Microphones for use in portable mass-market audio sensing devices may be manufactured at a sensitivity tolerance of plus or minus three decibels, for example, such that the sensitivity of two such microphones in an implementation of array R100 may differ by as much as six decibels.

The problem of channel response imbalance may be addressed during manufacture of a portable audio sensing device by using microphones whose responses have already been matched (e.g., via a sorting or binning process). Alternatively or additionally, a channel calibration procedure may be performed on the microphones of array R100 (or on a device that includes the array) in a laboratory and/or in a production facility, such as a factory. Such a procedure may compensate for the imbalance by calculating one or more gain factors and applying such factors to the corresponding channels to produce a balanced multichannel signal. Examples of calibration procedures that may be performed before service are described in U.S. patent application Ser. No. 12/473,930, filed May 28, 2009, entitled "SYSTEMS, METHODS, AND APPARATUS FOR MULTICHANNEL SIGNAL BALANCING" and U.S. patent application Ser. No. 12/334,246, entitled "SYSTEMS, METHODS, AND APPARATUS FOR MULTI-MICROPHONE BASED SPEECH ENHANCEMENT," filed Dec. 12, 2008. Such matching or calibration operations may increase the cost of producing the device, however, and they may also be ineffective against channel response imbalance that arises during the service life of the device (e.g., due to aging).

Alternatively or additionally, channel calibration may be performed in-service (e.g., as described in U.S. patent application Ser. No. 12/473,930). Such a procedure may be used to correct a response imbalance that arises over time and/or to correct an initial response imbalance. An initial response imbalance may be due to microphone mismatch, for example, and/or to an erroneous calibration procedure (e.g., a microphone is touched or covered during the procedure). In order to avoid distracting the user with a fluctuating channel level, it may be desirable for such a procedure to apply a compensation that changes gradually over time. For cases in which the initial response imbalance is large, however, such gradual compensation may lead to a long convergence period (e.g., from one to ten minutes or more), during which time an SSP operation on the multichannel signal may perform poorly, leading to an unsatisfactory user experience.

Phase analysis may be used to classify time-frequency points of a multichannel signal. For example, it may be desirable to configure a system, method, or apparatus to classify time-frequency points of a multichannel signal based on a difference, at each of a plurality of different frequencies, between estimated phases of the channels of the signal. Such configurations are referred to herein as "phase-based."

It may be desirable to use a phase-based scheme to identify time-frequency points that exhibit particular phase difference characteristics. For example, a phase-based scheme may be configured to apply information regarding the inter-microphone distance and the inter-channel phase differences to determine whether a particular frequency component of a sensed multichannel signal originated from within a range of allowable angles with respect to the array axis or from outside this range. Such a determination may be used to discriminate between sound components arriving from different directions (e.g., such that sound originating from within the allowable range is selected and sound originating outside that range is rejected) and/or to discriminate between sound components arriving from near-field and far-field sources.

In a typical application, such a system, method, or apparatus is used to calculate a direction of arrival with respect to a microphone pair for each time-frequency point over at least a portion of the multichannel signal (e.g., over a particular range of frequencies and/or over a particular time interval). A directional masking function may be applied to these results to distinguish points having directions of arrival within a desired range from points having other directions of arrival. Results from the directional masking operation may be used to attenuate sound components from undesired directions by discarding or attenuating time-frequency points having directions of arrival outside the mask.

As noted above, many multi-microphone spatial processing operations are inherently dependent upon the relative gain responses of the microphone channels, such that calibration of channel gain response may be necessary to enable such spatial processing operations. Performing such calibration during manufacture is typically time-consuming and/or otherwise expensive. A phase-based scheme, however, may be implemented to be relatively unaffected by a gain imbalance among the input channels, such that the degree to which the gain responses of the corresponding channels are matched to one another is not a limiting factor to the accuracy of the calculated phase differences and subsequent operations based on them (e.g., directional masking).

It may be desirable to exploit the robustness to channel imbalance of a phase-based scheme by using the classification results of such a scheme to support a channel calibration operation (also called a "channel balancing" operation) as described herein. For example, it may be desirable to use a phase-based scheme to identify frequency components and/or time intervals of a recorded multichannel signal that may be useful for channel balancing. Such a scheme may be configured to select time-frequency points whose directions of arrival indicate that they would be expected to produce a relatively equal response in each channel.

Figure 3B:
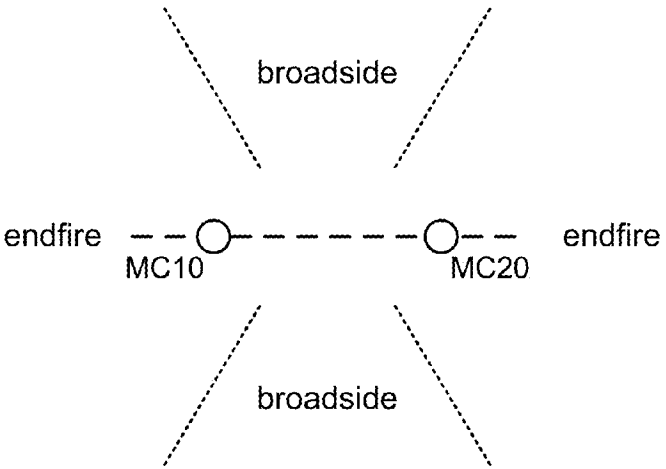
FIG. 3B shows examples of broadside and endfire regions with respect to a microphone array.
Figure 3A:
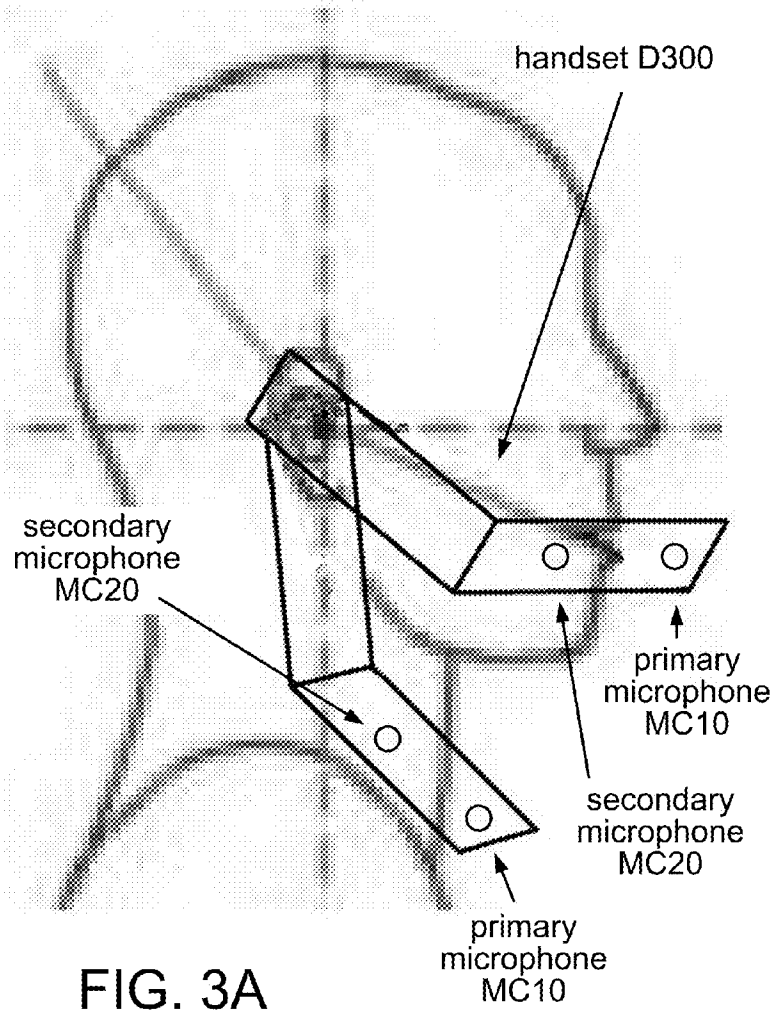
FIG. 3A shows a side view of a handset D300 in use.

Regarding a range of source directions with respect to a two-microphone array as shown in FIG. 3B, it may be desirable to use only sound components arriving from broadside directions (i.e., directions that are orthogonal to the array axis) for channel calibration. Such condition may be found, for example, when no near-field source is active and the sound source is distributed (e.g., background noise). It may also be acceptable to use sound components arriving from far-field endfire sources for calibration, as such components may be expected to give rise to a negligible interchannel gain level difference (e.g., due to dispersion). Near-field sound components that arrive from an endfire direction of the array (i.e., a direction near the array axis), however, would be expected to have a gain difference between the channels that represents source location information rather than channel imbalance. Consequently, using such components for calibration may produce an incorrect result, and it may be desirable to use a directional masking operation to distinguish such components from sound components that arrive from broadside directions.

Such a phase-based classification scheme may be used to support a calibration operation at run time (e.g., during use of the device, whether continuously or intermittently). In such manner, a quick and accurate channel calibration operation that is itself immune to channel gain response imbalance may be achieved. Alternatively, information from the selected time-frequency points may be accumulated over some period of time to support a channel calibration operation at a later time.

Figure 4B:
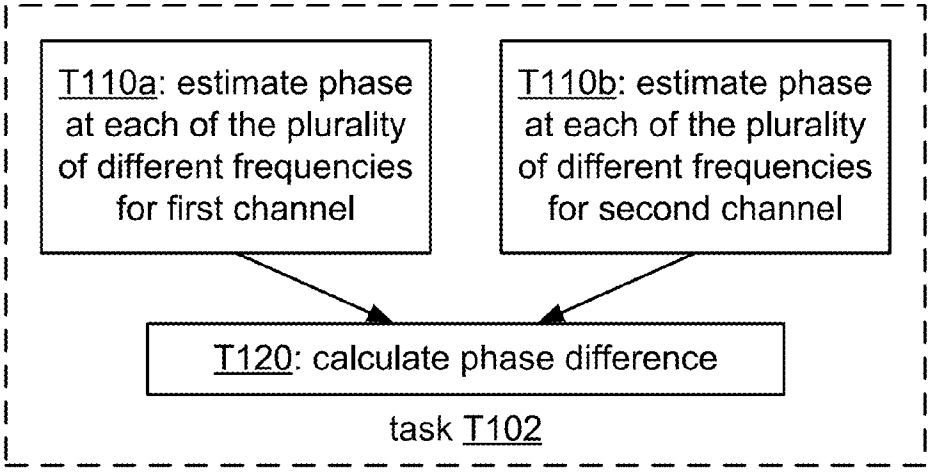
FIG. 4B shows a flowchart of an implementation T102 of task T100.
Figure 4C:
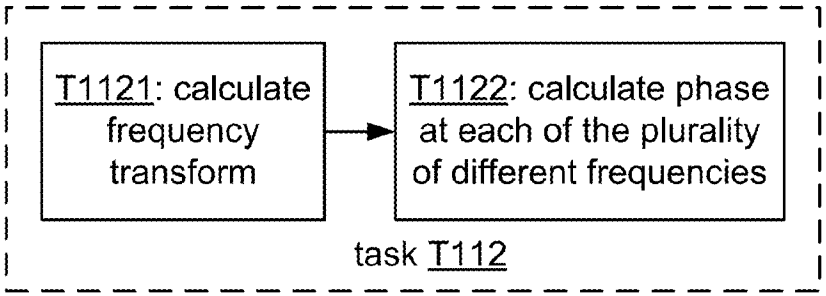
FIG. 4C shows a flowchart of an implementation T112 of task T110.
Figure 4A:
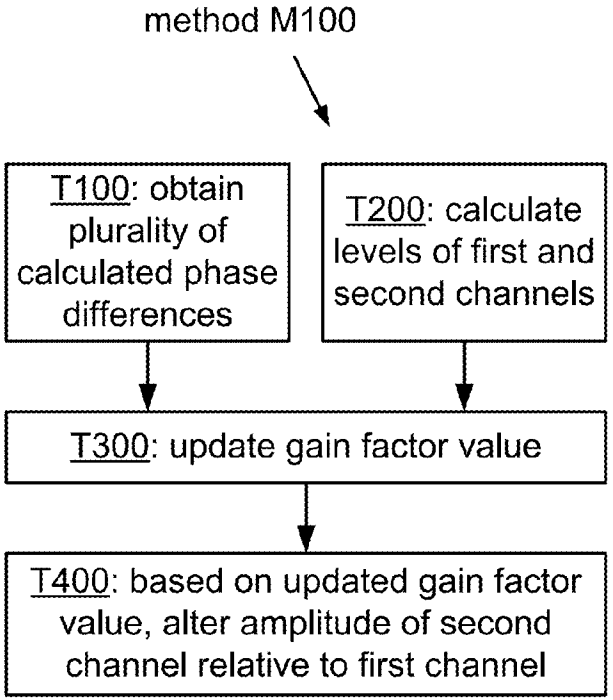
FIG. 4A shows a flowchart for a method M100 of processing a multichannel signal according to a general configuration.

FIG. 4A shows a flowchart for a method M100 of processing a multichannel signal according to a general configuration that includes tasks T100, T200, T300, and T400. Task T100 calculates a phase difference between channels of a multichannel signal (e.g., microphone channels) for each of a plurality of different frequency components of the signal. Task T200 calculates a level of a first channel of the multichannel signal and a corresponding level of a second channel of the multichannel signal. Based on the calculated levels and at least one of the calculated phase differences, task T300 updates a gain factor value. Based on the updated gain factor value, task T400 alters an amplitude of the second channel relative to a corresponding amplitude of the first channel to produce a processed (e.g., balanced) multichannel signal. Method M100 may also be used to support further operations on the multichannel signal (e.g., as described in more detail herein), such as SSP operations.

Method M100 may be configured to process the multichannel signal as a series of segments. Typical segment lengths range from about five or ten milliseconds to about forty or fifty milliseconds, and the segments may be overlapping (e.g., with adjacent segments overlapping by 25% or 50%) or nonoverlapping. In one particular example, the multichannel signal is divided into a series of nonoverlapping segments or "frames", each having a length of ten milliseconds. Task T100 may be configured to calculate a set (e.g., a vector) of phase differences for each of the segments. In some implementations of method M100, task T200 is configured to calculate a level for each of the segments of each channel, and task T300 is configured to update a gain factor value for at least some of the segments. In other implementations of method M100, task T200 is configured to calculate a set of subband levels for each of the segments of each channel, and task T300 is configured to update one or more of a set of subband gain factor values. A segment as processed by method M100 may also be a segment (i.e., a "subframe") of a larger segment as processed by a different operation, or vice versa.

FIG. 4B shows a flowchart of an implementation T102 of task T100. For each microphone channel, task T102 includes a respective instance of a subtask T110 that estimates the phase for the channel for each of the different frequency components. FIG. 4C shows a flowchart of an implementation T112 of task T110 that includes subtasks T1121 and T1122. Task T1121 calculates a frequency transform of the channel, such as a fast Fourier transform (FFT) or discrete cosine transform (DCT). Task T1121 is typically configured to calculate the frequency transform of the channel for each segment. It may be desirable to configure task T1121 to perform a 128-point or 256-point FFT of each segment, for example. An alternate implementation of task T1121 is configured to separate the various frequency components of the channel using a bank of subband filters.

Task T1122 calculates (e.g., estimates) the phase of the microphone channel for each of the different frequency components (also called "bins"). For each frequency component to be examined, for example, task T1122 may be configured to estimate the phase as the inverse tangent (also called the arctangent) of the ratio of the imaginary term of the corresponding FFT coefficient to the real term of the FFT coefficient.

Task T102 also includes a subtask T120 that calculates a phase difference $\Delta\phi$ for each of the different frequency components, based on the estimated phases for each channel. Task T120 may be configured to calculate the phase difference by subtracting the estimated phase for that frequency component in one channel from the estimated phase for that frequency component in the other channel. For example, task T120 may be configured to calculate the phase difference by subtracting the estimated phase for that frequency component in a primary channel from the estimated phase for that frequency component in another (e.g., secondary) channel. In such case, the primary channel may be the channel expected to have the highest signal-to-noise ratio, such as the channel corresponding to a microphone that is expected to receive the user's voice most directly during a typical use of the device.

It may be desirable to configure method M100 (or a system or apparatus configured to perform such a method) to estimate phase differences between channels of the multichannel signal over a wideband range of frequencies. Such a wideband range may extend, for example, from a low frequency bound of zero, fifty, one hundred, or two hundred Hz to a high frequency bound of three, 3.5, or four kHz (or even higher, such as up to seven or eight kHz or more). However, it may be unnecessary for task T100 to calculate phase differences across the entire bandwidth of the signal. For many bands in such a wideband range, for example, phase estimation may be impractical or unnecessary. The practical valuation of phase relationships of a received waveform at very low frequencies typically requires correspondingly large spacings between the transducers. Consequently, the maximum available spacing between microphones may establish a low frequency bound. On the other end, the distance between microphones should not exceed half of the minimum wavelength in order to avoid spatial aliasing. An eight-kilohertz sampling rate, for example, gives a bandwidth from zero to four kilohertz. The wavelength of a four-kHz signal is about 8.5 centimeters, so in this case, the spacing between adjacent microphones should not exceed about four centimeters. The microphone channels may be lowpass filtered in order to remove frequencies that might give rise to spatial aliasing.

Accordingly, it may be desirable to configure task T1122 to calculate phase estimates for fewer than all of the frequency components produced by task T1121 (e.g., for fewer than all of the frequency samples of an FFT performed by task T1121). For example, task T1122 may be configured to calculate phase estimates for a frequency range of from about fifty, 100, 200 or 300 Hz to about 500 or 1000 Hz (each of these eight combinations is expressly contemplated and disclosed). It may be expected that such a range will include components that are especially useful for calibration and will exclude components that are less useful for calibration.

It may be desirable to configure task T100 also to calculate phase estimates that will be used for purposes other than channel calibration. For example, task T100 may be configured also to calculate phase estimates that will be used to track and/or enhance a user's voice (e.g., as described in more detail below). In one such example, task T1122 is also configured to calculate phase estimates for the frequency range of 700 Hz to 2000 Hz, which may be expected to include most of the energy of the user's voice. For a 128-point FFT of a four-kilohertz-bandwidth signal, the range of 700 to 2000 Hz corresponds roughly to the twenty-three frequency samples from the tenth sample through the thirty-second sample. In further examples, task T1122 is configured to calculate phase estimates over a frequency range that extends from a lower bound of about fifty, 100, 200, 300, or 500 Hz to an upper bound of about 700, 1000, 1200, 1500, or 2000 Hz (each of the twenty-five combinations of these lower and upper bounds is expressly contemplated and disclosed).

Level calculation task T200 is configured to calculate a level for each of the first and second channels in a corresponding segment of the multichannel signal. Alternatively, task T200 may be configured to calculate a level for each of the first and second channels in each of a set of subbands of a corresponding segment of the multichannel signal. In such case, task T200 may be configured to calculate levels for each of a set of subbands that have the same width (e.g., a uniform width of 500, 1000, or 1200 Hz). Alternatively, task T200 may be configured to calculate levels for each of a set of subbands in which at least two (possibly all) of the subbands have different widths (e.g., a set of subbands that have nonuniform widths, such as widths according to a Bark or Mel scale division of the signal spectrum).

Task T200 may be configured to calculate a level L for each channel of a selected subband in the time domain as a measure of the amplitude or magnitude (also called "absolute amplitude" or "rectified amplitude") of the subband in the channel over a corresponding period of time (e.g., over a corresponding segment). Examples of measures of amplitude or magnitude include the total magnitude, the average magnitude, the root-mean-square (RMS) amplitude, the median magnitude, and the peak magnitude. In a digital domain, such a measure may be calculated over a block (or "frame") of n sample values $x_i$, i=1, 2, . . . , n, according to an expression such as one of the following:

$$\sum_{i=1}^{n} |x_i| \text{(total magnitude)}; \tag{1}$$

$$\frac{1}{n}\sum_{i=1}^{n} |x_i| \text{(average magnitude)}; \tag{2}$$

$$\sqrt{\frac{1}{n}\sum_{i=1}^{n} x_i^2} \text{ (RMS amplitude)}; \tag{3}$$

$$\text{median}_{i=1,2,\ldots,n} |x_i| \text{(median magnitude)}; \tag{4}$$

$$\max_{i=1,2,\ldots,n} |x_i| \text{(peak magnitude)}. \tag{5}$$

Task T200 may also be configured to calculate, according to such an expression, a level L for each channel of a selected subband in the frequency domain (e.g., a Fourier transform domain) or another transform domain (e.g., a discrete cosine transform (DCT) domain). Task T200 may also be configured to calculate the levels in the analog domain according to a similar expression (e.g., using integration in place of summation).

Alternatively, task T200 may be configured to calculate a level L for each channel of a selected subband in the time domain as a measure of the energy of the subband over a corresponding period of time (e.g., over a corresponding segment). Examples of measures of energy include the total energy and the average energy. In a digital domain, these measures may be calculated over a block of n sample values $x_i$, i=1, 2, . . . , n, according to expressions such as the following:

$$\sum_{i=1}^{n} x_i^2 \text{(total energy)}; \tag{6}$$

$$\frac{1}{n}\sum_{i=1}^{n} x_i^2 \text{(average energy)}. \tag{7}$$

Task T200 may also be configured to calculate, according to such an expression, a level L for each channel of a selected subband in the frequency domain (e.g., a Fourier transform domain) or another transform domain (e.g., a discrete cosine transform (DCT) domain). Task T200 may also be configured to calculate the levels in the analog domain according to a similar expression (e.g., using integration in place of summation). In a further alternative, task T200 is configured to calculate a level for each channel of a selected subband as a power spectral density (PSD) of the subband over a corresponding period of time (e.g., over a corresponding segment).

Alternatively, task T200 may be configured in an analogous manner to calculate a level $L_i$ for each channel i of a selected segment of the multichannel signal in the time domain, in the frequency domain, or in another transform domain as a measure of the amplitude, magnitude, or energy of the segment in the channel. For example, task T200 may be configured to calculate a level L for a channel of a segment as the sum of squares of the time-domain sample values of the segment in that channel, or as the sum of squares of the frequency-domain sample values of the segment in that channel, or as the PSD of the segment in that channel. A segment as processed by task T300 may also be a segment (i.e., a "subframe") of a larger segment as processed by a different operation, or vice versa.

It may be desirable to configure task T200 to perform one or more spectral shaping operations on the audio signal channels before calculating the level values. Such operations may be performed in the analog and/or digital domains. For example, it may be desirable to configure task T200 to apply a lowpass filter (with a cutoff frequency of, e.g., 200, 500, or 1000 Hz) or a bandpass filter (with a passband of, e.g., 200 Hz to 1 kHz) to the signal from the respective channel before calculating the corresponding level value or values.

Gain factor updating task T300 is configured to update a value for each of at least one gain factor, based on the calculated levels. For example, it may be desirable to configure task T300 to update each of the gain factor values based on an observed imbalance between the levels of each channel in the corresponding selected frequency component as calculated by task T200.

Such an implementation of task T300 may be configured to calculate the observed imbalance as a function of linear level values (e.g., as a ratio according to an expression such as $L_1/L_2$, where $L_1$ and $L_2$ denote the levels of the first and second channels, respectively). Alternatively, such an implementation of task T300 may be configured to calculate the observed imbalance as a function of level values in a logarithmic domain (e.g., as a difference according to an expression such as $L_1-L_2$).

Task T300 may be configured to use the observed imbalance as the updated gain factor value for the corresponding frequency component. Alternatively, task T300 may be configured to use the observed imbalance to update a corresponding previous value of the gain factor. In such case, task T300 may be configured to calculate the updated value according to an expression such as:

$$G_{in}=(\mu_i)G_{i(n-1)}+(1-\mu_i)R_{in}, \quad (8)$$

where $G_{in}$ denotes the gain factor value corresponding to segment n for frequency component i, $G_{i(n-1)}$ denotes the gain factor value corresponding to the previous segment (n−1) for frequency component i, $R_{in}$ denotes the observed imbalance calculated for frequency component i in segment n, and $\mu_i$ denotes a temporal smoothing factor having a value in the range of from 0.1 (maximum smoothing) to one (no smoothing), such as 0.3, 0.5, or 0.7. It is typical, but not necessary, for such an implementation of task T300 to use the same value of smoothing factor $\mu_i$ for each frequency component. It is also possible to configure task T300 to temporally smooth the values of the observed levels prior to calculation of the observed imbalance and/or to temporally smooth the values of the observed channel imbalance prior to calculation of the updated gain factor values.

As described in more detail below, gain factor updating task T300 is also configured to update a value for each of at least one gain factor based on information from the plurality of phase differences calculated in task T100 (e.g., identification of acoustically balanced portions of the multichannel signal). At any particular segment of the multichannel signal, task T300 may update fewer than all of the set of gain factor values. For example, the presence of a source that causes a frequency component to remain acoustically imbalanced during the calibration operation may impede task T300 from calculating an observed imbalance and a new gain factor value for that frequency component. Consequently, it may be desirable to configure task T300 to smooth the values of the observed levels, the observed imbalances, and/or the gain factors over frequency. For example, task T300 may be configured to calculate an average value of the observed levels (or of the observed imbalances or gain factors) of the selected frequency components and assign this calculated average value to the nonselected frequency components. In another example, task T300 is configured to update the gain factor values that correspond to nonselected frequency components i according to an expression such as:

$$G_{in}=(\beta)G_{i(n-1)}+(1-\beta)G_{(i-1)n}, \quad (9)$$

where $G_{in}$ denotes the gain factor value corresponding to segment n for frequency component i, $G_{i(n-1)}$ denotes the gain factor value corresponding to the previous segment (n−1) for frequency component i, $G_{(i-1)n}$ denotes the gain factor value corresponding to segment n for neighboring frequency component (i−1), and β is a frequency smoothing factor having a value in the range of from zero (no updating) to one (no smoothing). In a further example, expression (9) is changed to use the gain factor value for the closest selected frequency component in place of $G_{(i-1)n}$. Task T300 may be configured to perform smoothing over frequency before, after, or at the same time as temporal smoothing.

Task T400 produces a processed multichannel signal (also called a "balanced" or "calibrated" signal) by altering a response characteristic (e.g., a gain response) of a channel of the multichannel signal relative to the corresponding response characteristic of another channel of the multichannel signal, based on the at least one gain factor values updated in task T300. Task T400 may be configured to produce the processed multichannel signal by using each of a set of subband gain factor values to vary the amplitude of a corresponding frequency component in the second channel relative to the amplitude of that frequency component in the first channel. Task T400 may be configured to amplify the signal from a less responsive channel, for example. Alternatively, task T400 may be configured to control the amplitude of (e.g., to amplify or attenuate) the frequency components in a channel that corresponds to a secondary microphone. As noted above, at any particular segment of the multichannel signal, it is possible that fewer than all of the set of gain factor values are updated.

Task T400 may be configured to produce the processed multichannel signal by applying a single gain factor value to each segment of the signal, or by otherwise applying a gain factor value to more than one frequency component. For example, task T400 may be configured to apply the updated gain factor value to alter an amplitude of a secondary microphone channel relative to the corresponding amplitude of a primary microphone channel (e.g., to amplify or attenuate the secondary microphone channel relative to the primary microphone channel).

Task T400 may be configured to perform channel response balancing in a linear domain. For example, task T400 may be configured to control the amplitude of the second channel of a segment by multiplying each of the values of the time-domain samples of the segment in that channel by a value of the gain factor that corresponds to the segment. For a subband gain factor, task T400 may be configured to control the amplitude of a corresponding frequency component in the second channel by multiplying the amplitude by the value of the gain factor, or by using a subband filter to apply the gain factor to a corresponding subband in the time domain.

Alternatively, task T400 may be configured to perform channel response balancing in a logarithmic domain. For example, task T400 may be configured to control the amplitude of the second channel of a segment by adding a corresponding value of the gain factor to a logarithmic gain control value that is applied to that channel over the duration of the segment. For a subband gain factor, task T400 may be configured to control the amplitude of a frequency component in the second channel by adding the value of the corresponding gain factor to the amplitude. In such cases, task T400 may be configured to receive the amplitude and gain factor values as logarithmic values (e.g., in decibels) and/or to convert linear amplitude or gain factor values to logarithmic values (e.g., according to an expression such as $x_{log}=20 \log x_{lin}$, where $x_{lin}$ is a linear value and $x_{log}$ is the corresponding logarithmic value).

Task T400 may be combined with, or performed upstream or downstream of, other amplitude control of the channel or channels (e.g., an automatic gain control (AGC) or automatic volume control (AVC) module, a user-operated volume control, etc.).

For an array of more than two microphones, it may be desirable to perform a respective instance of method M100 on each of two or more pairs of channels such that the response of each channel is balanced with the response of at least one other channel. For example, one instance of method M100 (e.g., of method M110) may be executed to calculate a coherency measure based on one pair of channels (e.g., first and second channels), while another instance of method M100 is executed to calculate a coherency measure based on another pair of channels (e.g., the first channel and a third channel, or third and fourth channels). For cases in which no common operation is performed on a pair of channels, however, balancing of that pair may be omitted.

Gain factor updating task T300 may include using information from the calculated phase differences to indicate frequency components and/or segments of the multichannel signal that are expected to have the same level in each channel (e.g., frequency components and/or segments that are expected to cause an equal response by the respective microphone channels, also referred to herein as "acoustically balanced portions") and to calculate one or more gain factor values based on information from those portions. It may be expected that sound components which are received from sources in the broadside directions of array R100 will cause equal responses by microphones MC10 and MC20. Conversely, it may be expected that sound components received from near-field sources in either of the endfire directions of array R100 will cause one microphone to have a higher output level than the other (i.e., will be "acoustically imbalanced"). Therefore, it may be desirable to configure task T300 to use a phase difference calculated in task T100 to determine whether a corresponding frequency component of the multichannel signal is acoustically balanced or acoustically imbalanced.

Task T300 may be configured to perform a directional masking operation on phase differences calculated by task T100 to obtain a mask score for each of the corresponding frequency components. In accordance with the discussion above regarding phase estimation by task T100 over a limited frequency range, task T300 may be configured to obtain mask scores for fewer than all of the frequency components of the signal (e.g., for fewer than all of the frequency samples of an FFT performed by task T1121).

Figure 5C:
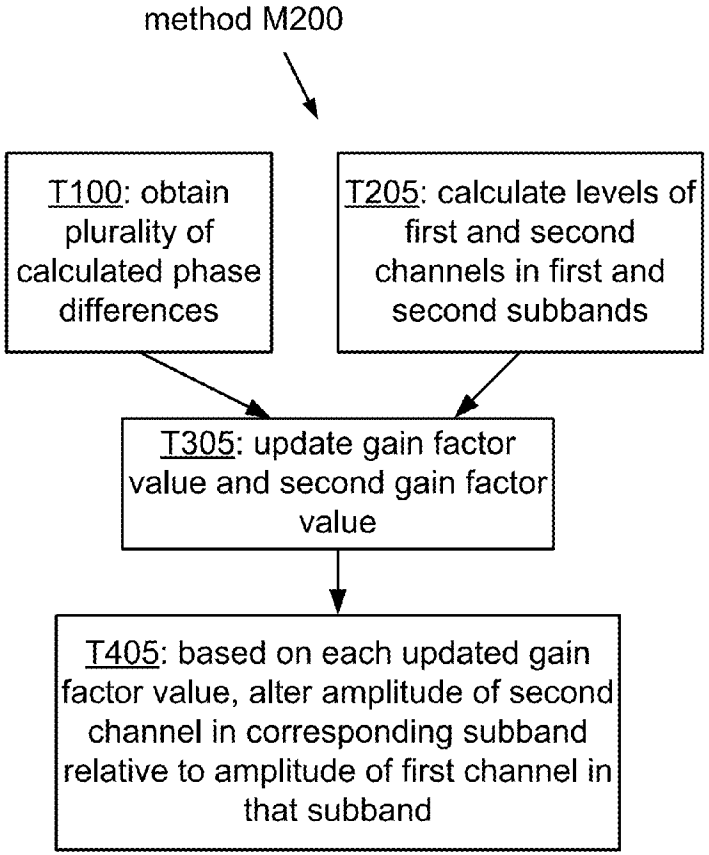
FIG. 5C shows a flowchart of an implementation M200 of method M100.
Figure 5A:
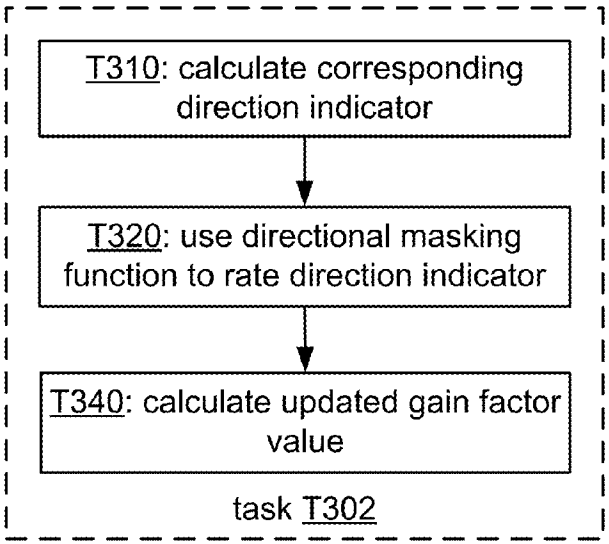
FIG. 5A shows a flowchart of an implementation T302 of task T300.

FIG. 5A shows a flowchart of an implementation T302 of task T300 that includes subtasks T310, T320, and T340. For each of a plurality of the calculated phase differences from task T100, task T310 calculates a corresponding direction indicator. Task T320 uses a directional masking function to rate the direction indicators (e.g., to convert or map the values of the direction indicators to values on an amplitude or magnitude scale). Based on the ratings produced by task T320, task T340 calculates updated gain factor values (e.g., according to expression (8) or (9) above). For example, task T340 may be configured to select frequency components of the signal whose ratings indicate that they are acoustically balanced and to calculate an updated gain factor value for each of these components that is based on an observed imbalance between the channels for that component.

Task T310 may be configured to calculate each of the direction indicators as a direction of arrival $\theta_i$ of the corresponding frequency component $f_i$ of the multichannel signal. For example, task T310 may be configured to estimate the direction of arrival $\theta_i$ as the inverse cosine (also called the arccosine) of the quantity $$\frac{c\Delta\varphi_i}{d2\pi f_i},$$

where c denotes the speed of sound (approximately 340 m/sec), d denotes the distance between the microphones, $\Delta\phi_i$ denotes the difference in radians between the corresponding phase estimates for the two microphones, and $f_i$ is the frequency component to which the phase estimates correspond (e.g., the frequency of the corresponding FFT samples, or a center or edge frequency of the corresponding subbands). Alternatively, task T310 may be configured to estimate the direction of arrival $\theta_i$ as the inverse cosine of the quantity $$\frac{\lambda_i\Delta\varphi_i}{d2\pi},$$

where $\lambda_i$ denotes the wavelength of frequency component $f_i$.

Figure 6A:
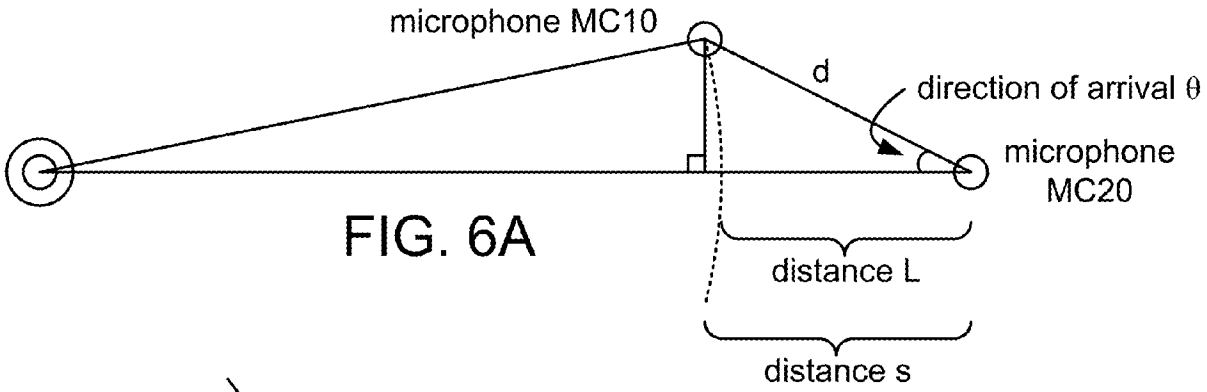
FIG. 6A shows an example of a geometric approximation that illustrates an approach to estimating direction of arrival.

FIG. 6A shows an example of a geometric approximation that illustrates this approach to estimating direction of arrival $\theta$ with respect to microphone MC20 of a two-microphone array MC10, MC20. In this example, a value of $\theta_i=0$ indicates a signal arriving at microphone MC20 from a reference endfire direction (i.e., the direction of microphone MC10), a value of $\theta_i=\pi$ indicates a signal arriving from the other endfire direction, and a value of $\theta_i=\pi/2$ indicates a signal arriving from a broadside direction. In another example, task T310 may be configured to evaluate $\theta_i$ with respect to a different reference position (e.g., microphone MC10 or some other point, such as a point midway between the microphones) and/or a different reference direction (e.g., the other endfire direction, a broadside direction, etc.).

The geometric approximation shown in FIG. 6A assumes that the distance s is equal to the distance L, where s is the distance between the position of microphone MC20 and the orthogonal projection of the position of microphone MC10 onto the line between the sound source and microphone MC20, and L is the actual difference between the distances of each microphone to the sound source. The error (s−L) becomes smaller as the direction of arrival $\theta$ with respect to microphone MC20 approaches zero. This error also becomes smaller as the relative distance between the sound source and the microphone array increases.

Figure 6B:
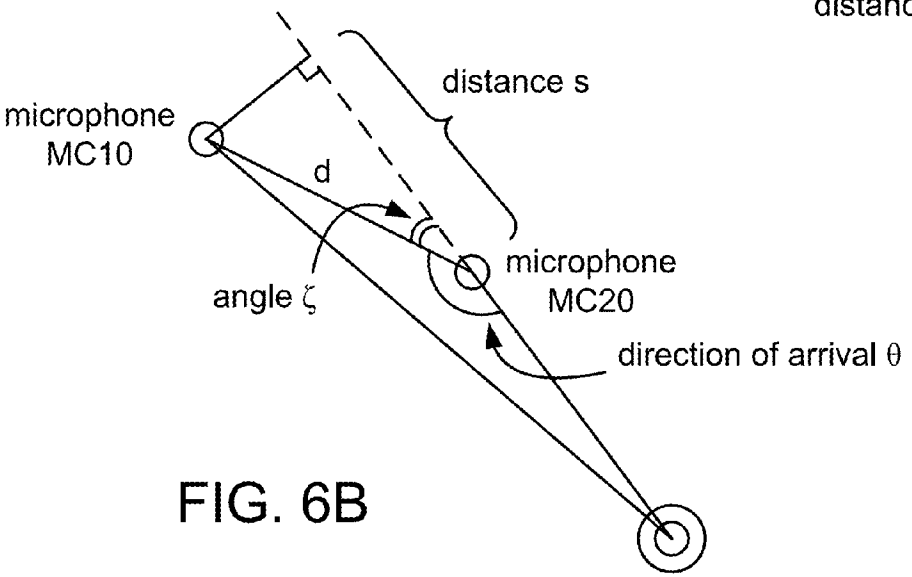
FIG. 6B shows an example of using the approximation of FIG. 6A for second- and third-quadrant values.

The scheme illustrated in FIG. 6A may be used for first- and fourth-quadrant values of $\Delta\phi_i$ (i.e., from zero to $+\pi/2$ and zero to $-\pi/2$). FIG. 6B shows an example of using the same approximation for second- and third-quadrant values of $\Delta\phi_i$ (i.e., from $+\pi/2$ to $-\pi/2$). In this case, an inverse cosine may be calculated as described above to evaluate the angle $\zeta$, which is then subtracted from $\pi$ radians to yield direction of arrival $\theta_i$. The practicing engineer will also understand that direction of arrival $\theta_i$ may be expressed in degrees or any other units appropriate for the particular application instead of radians.

It may be desirable to configure task T300 to select frequency components having directions of arrival close to $\pi/2$ radians (e.g., in a broadside direction of the array). Consequently, the distinction between first- and fourth-quadrant values of $\Delta\phi_i$ on one hand, and second- and third-quadrant values of $\Delta\phi_i$ on the other hand, may become unimportant for calibration purposes.

In an alternative implementation, task T310 is configured to calculate each of the direction indicators as a time delay of arrival $\tau_i$ (e.g., in seconds) of the corresponding frequency component $f_i$ of the multichannel signal. Task T310 may be configured to estimate the time delay of arrival $\tau_i$ at microphone MC20 with reference to microphone MC10, using an expression such as $$\tau_i = \frac{\lambda_i \Delta\varphi_i}{c2\pi} \text{ or } \tau_i = \frac{\Delta\varphi_i}{2\pi f_i}.$$

In these examples, a value of $\tau_i=0$ indicates a signal arriving from a broadside direction, a large positive value of $\tau_i$ indicates a signal arriving from the reference endfire direction, and a large negative value of $\tau_i$ indicates a signal arriving from the other endfire direction. In calculating the values $\tau_i$, it may be desirable to use a unit of time that is deemed appropriate for the particular application, such as sampling periods (e.g., units of 125 microseconds for a sampling rate of 8 kHz) or fractions of a second (e.g., $10^{-3}$, $10^{-4}$, $10^{-5}$, or $10^{-6}$ sec). It is noted that task T310 may also be configured to calculate time delay of arrival $\tau_i$ by cross-correlating the frequency components $f_i$ of each channel in the time domain.

For sound components arriving directly from the same point source, the value of $$\frac{\Delta\varphi}{f}$$

is ideally equal to a constant k for all frequencies, where the value of k is related to the direction of arrival θ and the time delay of arrival τ. In another alternative implementation, task T310 is configured to calculate each of the direction indicators as a ratio $r_i$ between estimated phase difference $\Delta\phi_i$ and frequency $$f_i\left(\text{e.g., } r_i = \frac{\Delta\varphi_i}{f_i}, \text{ or } r_i = \frac{f_i}{\Delta\varphi_i}\right).$$

Figure 7:
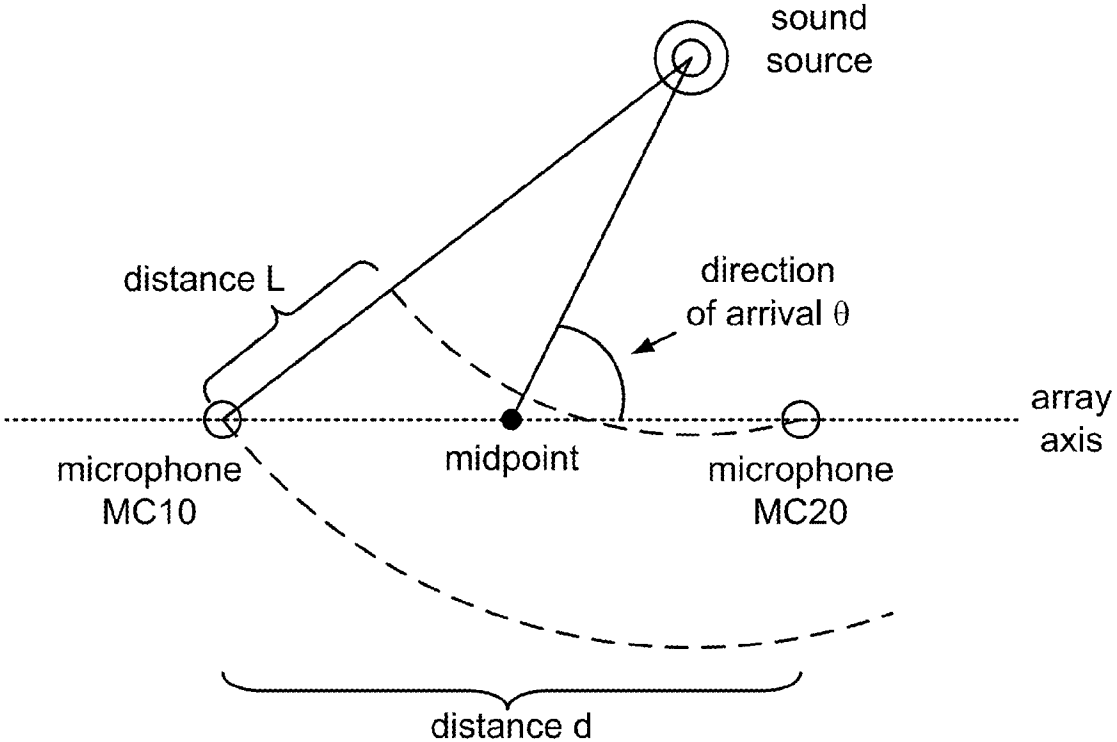
FIG. 7 shows an example of a model that assumes a spherical wavefront.

It is noted that while the expression $$\theta_i = \cos^{-1}\left(\frac{c\Delta\varphi_i}{d2\pi f_i}\right) \text{ or } \theta_i = \cos^{-1}\left(\frac{\lambda_i \Delta\varphi_i}{d2\pi}\right)$$

calculates the direction indicator $\theta_i$ according to a far-field model (i.e., a model that assumes a planar wavefront), the expressions $$\tau_i = \frac{\lambda_i \Delta\varphi_i}{c2\pi},$$

$$\tau_i = \frac{\Delta\varphi_i}{2\pi f_i},$$

$$r_i = \frac{\Delta\varphi_i}{f_i},$$

and $$r_i = \frac{f_i}{\Delta\varphi_i}$$

calculate the direction indicators $\tau_i$ and $r_i$ according to a near-field model (i.e., a model that assumes a spherical wavefront, as illustrated in FIG. 7). While a direction indicator that is based on a near-field model may provide a result that is more accurate and/or easier to compute, a direction indicator that is based on a far-field model provides a nonlinear mapping between phase difference and direction indicator value that may be desirable for some configurations of method M100.

Task T302 also includes a subtask T320 that rates the direction indicators produced by task T310. Task T320 may be configured to rate the direction indicators by converting or mapping the value of the direction indicator, for each frequency component to be examined, to a corresponding value on an amplitude, magnitude, or pass/fail scale (also called a "mask score"). For example, task T320 may be configured to use a directional masking function to map the value of each direction indicator to a mask score that indicates whether (and/or how well) the indicated direction falls within the masking function's passband. (In this context, the term "passband" refers to the range of directions of arrival that are passed by the masking function.) The set of mask scores for the various frequency components may be considered as a vector. Task T320 may be configured to rate the various direction indicators serially and/or in parallel.

The passband of the masking function may be selected to include a desired signal direction. The spatial selectivity of the masking function may be controlled by varying the width of the passband. For example, it may be desirable to select the passband width according to a tradeoff between convergence rate and calibration accuracy. While a wider passband may allow for more rapid convergence by allowing more of the frequency components to contribute to the calibration operation, it would also be expected to be less accurate by admitting components that arrive from directions that are farther from the broadside axis of the array (and thus may be expected to affect the microphones differently). In one example, task T300 (e.g., task T320, or task T330 as described below) is configured to select components that arrive from directions within fifteen degrees of the broadside axis of the array (i.e., components having directions of arrival in the range of seventy-five to 105 degrees or, equivalently, 5π/12 to 7π/12 radians).

Figure 8A:
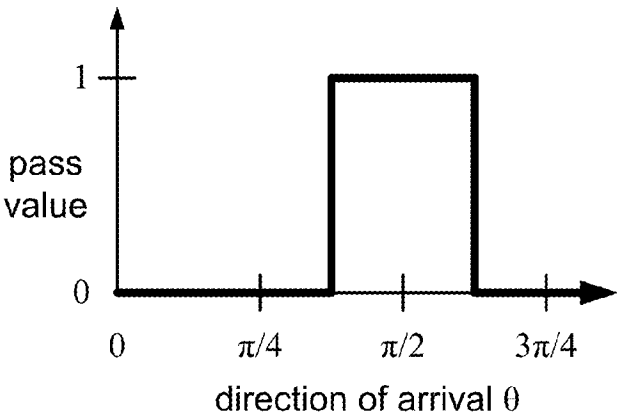
FIG. 8A shows an example of a masking function having relatively sudden transitions between passband and stopband.

FIG. 8A shows an example of a masking function having relatively sudden transitions between passband and stopband (also called a "brickwall" profile) and a passband centered at direction of arrival θ=π/2. In one such case, task T320 is configured to assign a binary-valued mask score having a first value (e.g., one) when the direction indicator indicates a direction within the function's passband, and a mask score having a second value (e.g., zero) when the direction indicator indicates a direction outside the function's passband. It may be desirable to vary the location of the transition between stopband and passband depending on one or more factors such as signal-to-noise ratio (SNR), noise floor, etc. (e.g., to use a more narrow passband when the SNR is high, indicating the presence of a desired directional signal that may adversely affect calibration accuracy).

Figure 8B:
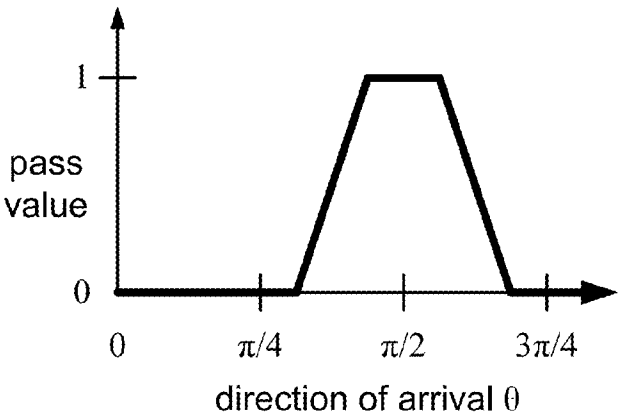
FIG. 8B shows an example of a linear rolloff for a masking function.
Figure 8C:
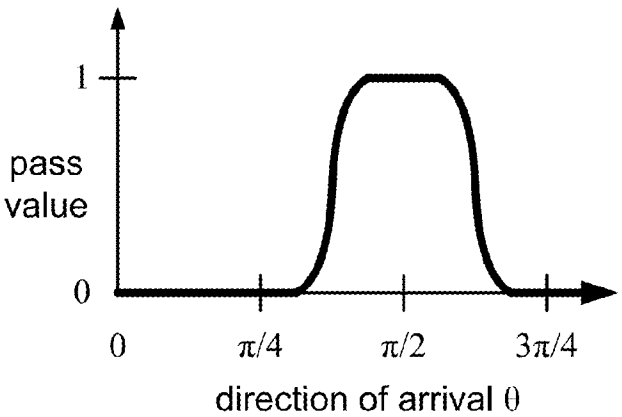
FIG. 8C shows an example of a nonlinear rolloff for a masking function.

Alternatively, it may be desirable to configure task T320 to use a masking function having less abrupt transitions between passband and stopband (e.g., a more gradual rolloff, yielding a non-binary-valued mask score). FIG. 8B shows an example of a linear rolloff for a masking function having a passband centered at direction of arrival θ=π/2, and FIG. 8C shows an example of a nonlinear rolloff for a masking function having a passband centered at direction of arrival θ=π/2. It may be desirable to vary the location and/or the sharpness of the transition between stopband and passband depending on one or more factors such as SNR, noise floor, etc. (e.g., to use a more abrupt rolloff when the SNR is high, indicating the presence of a desired directional signal that may adversely affect calibration accuracy). Of course, a masking function (e.g., as shown in FIGS. 8A-C) may also be expressed in terms of time delay τ or ratio r rather than direction θ. For example, a direction of arrival θ=π/2 corresponds to a time delay τ or ratio $$r = \frac{\Delta\varphi}{f} \text{ of zero.}$$

One example of a nonlinear masking function may be expressed as $$m = \frac{1}{1 + \exp\left(\gamma\left[|\theta - \theta_T| - \left(\frac{w}{2}\right)\right]\right)},$$

where $\theta_T$ denotes a target direction of arrival, w denotes a desired width of the mask in radians, and $\gamma$ denotes a sharpness parameter. FIGS. 9A-C show examples of such a function for ($\gamma$, w, $\theta_T$) equal to $$\left(8, \frac{\pi}{2}, \frac{\pi}{2}\right), \left(20, \frac{\pi}{4}, \frac{\pi}{2}\right), \text{ and } \left(50, \frac{\pi}{8}, \frac{\pi}{2}\right),$$

respectively. Of course, such a function may also be expressed in terms of time delay $\tau$ or ratio r rather than direction $\theta$. It may be desirable to vary the width and/or sharpness of the mask depending on one or more factors such as SNR, noise floor, etc. (e.g., to use a more narrow mask and/or a more abrupt rolloff when the SNR is high).

Figure 5B:
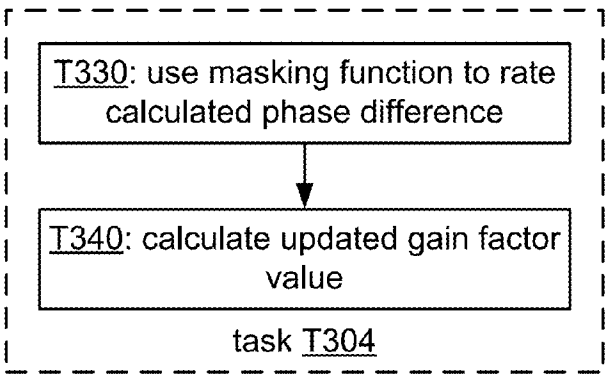
FIG. 5B shows a flowchart of an alternate implementation T304 of task T300.

FIG. 5B shows a flowchart of an alternate implementation T304 of task T300. Instead of using the same masking function to rate each of a plurality of direction indicators, task T304 includes a subtask T330 that uses the calculated phase differences as the direction indicators, rating each phase difference $\Delta\phi_i$ using a corresponding directional masking function $m_i$. For a case in which it is desired to select sound components arriving from directions in the range of from $\theta_L$ to $\theta_H$, for example, each masking function $m_i$ may be configured to have a passband that ranges from $\Delta\phi_L$ to $\Delta\phi_H$, where $$\Delta\varphi_L = \frac{d2\pi f_i}{c}\cos\theta_H \left(\text{equivalently, } \Delta\varphi_L = \frac{d2\pi}{\lambda_i}\cos\theta_H\right)$$

and $$\Delta\varphi_H = \frac{d2\pi f_i}{c}\cos\theta_L \left(\text{equivalently, } \Delta\varphi_H = \frac{d2\pi}{\lambda_i}\cos\theta_L\right).$$

For a case in which it is desired to select sound components arriving from directions corresponding to the range of time delay of arrival from $\tau_L$ to $\tau_H$, each masking function $m_i$ may be configured to have a passband that ranges from $\Delta\phi_{Li}$ to $\Delta\phi_{Hi}$, where $$\Delta\varphi_{Li} = 2\pi f_i \tau_L \left(\text{equivalently, } \Delta\varphi_{Li} = \frac{c2\pi\tau_L}{\lambda_i}\right)$$

and $$\Delta\varphi_{Hi} = 2\pi f_i \tau_H \left(\text{equivalently, } \Delta\varphi_{Hi} = \frac{c2\pi\tau_H}{\lambda_i}\right).$$

For a case in which it is desired to select sound components arriving from directions corresponding to the range of the ratio of phase difference to frequency from $r_L$ to $r_H$, each masking function $m_i$ may be configured to have a passband that ranges from $\Delta\phi_{Li}$ to $\Delta\phi_{Hi}$, where $\Delta\phi_{Li}=f_i r_L$ and $\Delta\phi_{Hi}=f_i r_H$. As discussed above with reference to task T320, the profile of each masking function may be selected according to one or more factors such as SNR, noise floor, etc.

It may be desirable to configure task T300 to produce the mask scores for each of one or more (possibly all) of the frequency components as temporally smoothed values. Such an implementation of task T300 may be configured to calculate such a value as the mean value of the mask scores for that frequency component over the most recent m frames, where possible values of m include five, ten, twenty, and fifty. More generally, such an implementation of task T300 may be configured to calculate a smoothed value using a temporal smoothing function, such as a finite- or infinite-impluse-response (FIR or IIR) filter. In one such example, task T300 is configured to calculate the smoothed value $v_i(n)$ of the mask score for frequency component i of frame n according to an expression such as $v_i(n)=\alpha_i v_i(n-1)+(1-\alpha_i)c_i(n)$, where $v_i(n-1)$ denotes the smoothed value of the mask score for frequency component i for the previous frame, $c_i(n)$ denotes the current value of the mask score for frequency component i, and $\alpha_i$ is a smoothing factor whose value may be selected from the range of from zero (no smoothing) to one (no updating). This first-order IIR filter may also be referred to as a "leaky integrator."

Typical values for smoothing factor $\alpha_i$ include 0.99, 0.09, 0.95, 0.9, and 0.8. It is typical, but not necessary, for task T300 to use the same value of $\alpha_i$ for each frequency component of a frame. During an initial convergence period (e.g., immediately following a power-on or other activation of the audio sensing circuitry), it may be desirable for task T300 to calculate the smoothed value over a shorter interval, or to use a smaller value for one or more (possibly all) of smoothing factors $\alpha_i$, than during subsequent steady-state operation.

Task T340 may be configured to use information from the plurality of mask scores to select acoustically balanced portions of the signal. Task T340 may be configured to take binary-valued mask scores as direct indicators of acoustic balance. For a mask whose passband is in a broadside direction of array R100, for example, task T340 may be configured to select frequency components having mask scores of one, while for a mask whose passbands are in the endfire directions of array R100 (e.g., as shown in FIG. 3B), task T340 may be configured to select frequency components having mask scores of zero.

For the case of a non-binary-valued mask score, task T340 may be configured to compare the mask score to a threshold value. For a mask whose passband is in a broadside direction of array R100, for example, it may be desirable for task T340 to identify a frequency component as an acoustically balanced portion if its mask score is greater than (alternatively, not less than) the threshold value. Similarly, for a mask whose passbands are in the endfire directions of array R100, it may be desirable for task T340 to identify a frequency component as an acoustically balanced portion if its mask score is less than (alternatively, not greater than) the threshold value.

Such an implementation of task T340 may be configured to use the same threshold value for all of the frequency components. Alternatively, task T340 may be configured to use different threshold values for each of two or more (possibly all) of the frequency components. Task T340 may be configured to use a fixed threshold value (or values) or, alternatively, may be configured to adapt the threshold value (or values)

from one segment to another over time based on a characteristic of the signal (e.g., frame energy) and/or a characteristic of the mask (e.g., passband width).

FIG. 5C shows a flowchart of an implementation M200 of method M100 that includes an implementation T205 of task T200; an implementation T305 of task T300 (e.g., of task T302 or T304); and an implementation T405 of task T400. Task T205 is configured to calculate a level for each channel in each of (at least) two subbands. Task T305 is configured to update a gain factor value for each of the subbands, and task T405 is configured to apply each updated gain factor value to alter an amplitude of the second channel in the corresponding subband relative to a amplitude of the first channel in that subband.

When a signal is received without reverberation from an ideal point source, all frequency components should have the same direction of arrival (for example, the value of the ratio $$\frac{\Delta\varphi}{f}$$

should be constant over all frequencies). The degree to which different frequency components of a signal have the same direction of arrival is also called "directional coherence." When a microphone array receives a sound that originates from a far-field source (e.g., a background noise source), the resulting multichannel signal will typically be less directionally coherent than for a received sound that originates from a near-field source (e.g., the user's voice). For example, the phase differences between microphone channels at each of the different frequency components will typically be less correlated with frequency for a received sound that originates from a far-field source than for a received sound that originates from a near-field source.

It may be desirable to configure task T300 to use directional coherence, as well as direction of arrival, to indicate whether a portion of the multichannel signal (e.g., a segment or subband) is acoustically balanced or acoustically imbalanced. For example, it may be desirable to configure task T300 to select acoustically balanced portions of the multichannel signal based on the degree to which the frequency components in those portions are directionally coherent. Use of directional coherence may support increased accuracy and/or reliability of the channel calibration operation, for example, by enabling the rejection of segments or subbands that include activity by a directionally coherent source (e.g., a near-field source) located in an endfire direction of the array.

Figure 10:
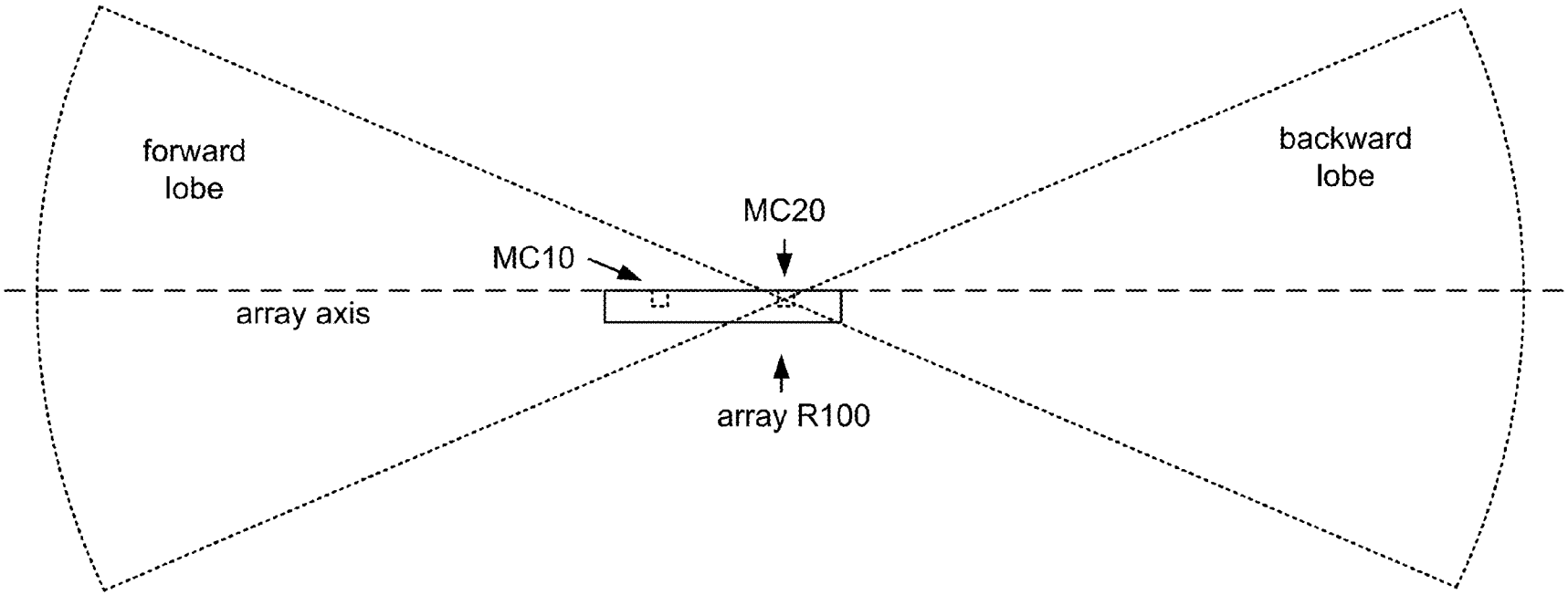
FIG. 10 shows forward and backward lobes of a directional pattern of a masking function.

FIG. 10 shows forward and backward lobes of a directional pattern of a masking function as may be applied by an implementation of task T300 to a multichannel signal from a two-microphone array R100. It may be expected that sound components received from sources located outside this pattern, such as near-field sources in the broadside directions of array R100 or far-field sources in any direction, will be acoustically balanced (i.e., will cause equal responses by microphones MC10 and MC20). Similarly, it may be expected that sound components received from sources within the forward or backward lobes of such a pattern (i.e., near-field sources in either of the endfire directions of array R100) will be acoustically imbalanced (i.e., will cause one microphone to have a higher output level than the other). Therefore, it may be desirable to configure a corresponding implementation of task T300 to select segments or subbands that do not have sources within either lobe of such a masking function pattern (e.g., segments or subbands that are not directionally coherent or that are coherent only in a broadside direction).

As noted above, task T300 may be configured to use information from the phase differences calculated by task T100 to identify acoustically balanced portions of the multichannel signal. Task T300 may be implemented to identify acoustically balanced portions as subbands or segments of the signal whose mask scores indicate that they are directionally coherent in a broadside direction of the array (or, alternatively, not directionally coherent in an endfire direction), such that updating of a corresponding gain factor value is performed only for such identified subbands or segments.

Figure 11A:
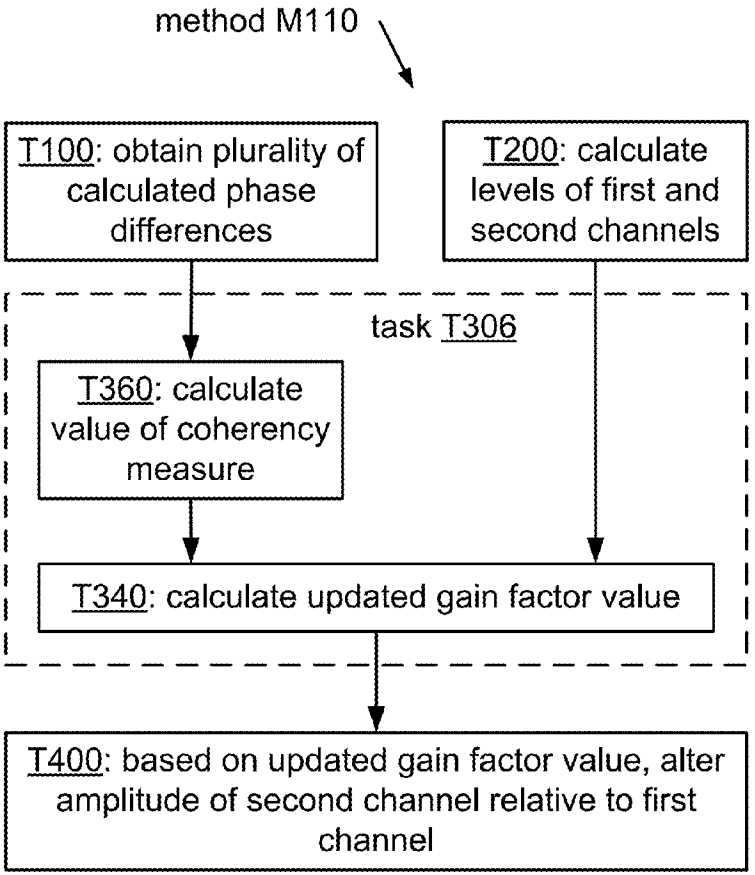
FIG. 11A shows a flowchart of an implementation M110 of method M100.
Figure 11B:
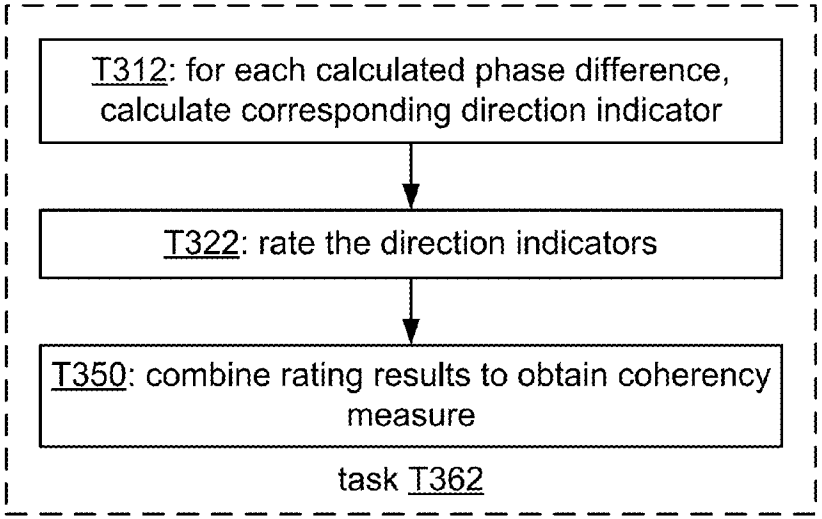
FIG. 11B shows a flowchart of an implementation T362 of task T360.
Figure 11C:
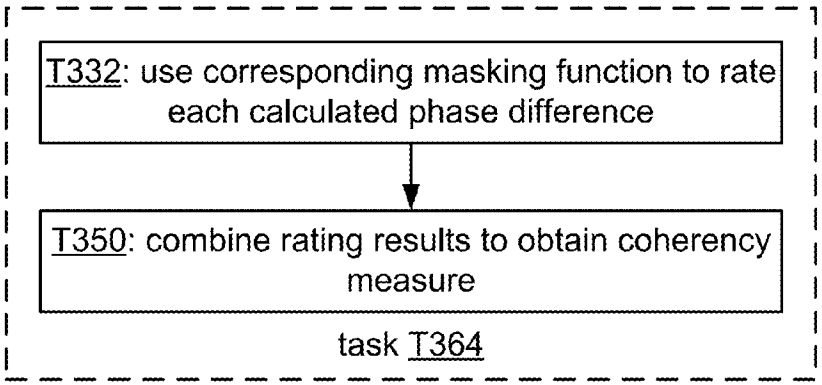
FIG. 11C shows a flowchart of an implementation T364 of task T360.

FIG. 11A shows a flowchart of an implementation M110 of method M100 that includes an implementation T306 of task T300. Task T306 includes a subtask T360 that calculates a value of a coherency measure, based on information from the phase differences calculated by task T100. FIG. 11B shows a flowchart of an implementation T362 of task T360 that includes instances of subtasks T312 and T322 as described above and a subtask T350. FIG. 11C shows a flowchart of an implementation T364 of task T360 that includes an instance of subtask T332 as described above and subtask T350.

Task T350 may be configured to combine the mask scores of the frequency components in each subband to obtain a coherency measure for the subband. In one such example, task T350 is configured to calculate the coherency measure based on the number of mask scores having a particular state. In another example, task T350 is configured to calculate the coherency measure as a sum of the mask scores. In a further example, task T350 is configured to calculate the coherency measure as an average of the mask scores. In any of these cases, task T350 may be configured to weight each of the mask scores equally (e.g., to weight each mask score by one) or to weight one or more mask scores differently from one another (e.g., to weight a mask score that corresponds to a low- or high-frequency component less heavily than a mask score that corresponds to a mid-range frequency component).

For a mask whose passband is in a broadside direction of array R100 (e.g., as shown in FIGS. 8A-C and 9A-C), task T350 may be configured to produce a coherency indication having a first state (e.g., high or "1"), for example, if the sum or average of the mask scores is not less than (alternatively, is greater than) a threshold value, or if at least (alternatively, if more than) a minimum number of frequency components in the subband have mask scores of one, and a second state (e.g., low or "0") otherwise. For a mask whose passband is in an endfire direction of array R100, task T350 may be configured to produce a coherency measure having a first state, for example, if the sum or average of the mask scores is not greater than (alternatively, is less than) a threshold value, or if not more than (alternatively, if less than) a maximum number of frequency components in the subband have mask scores of one, and a second state otherwise.

Task T350 may be configured to use the same threshold value for each subband or to use a different threshold value for each of two or more (possibly all) of the subbands. Each threshold value may be determined heuristically, and it may be desirable to vary a threshold value over time depending on one or more factors such as passband width, one or more characteristics of the signal (e.g., SNR, noise floor), etc. (The same principles apply to the maximum and minimum numbers mentioned in the previous paragraph.)

Alternatively, task T350 may be configured to produce a corresponding directional coherency measure for each of a series of segments of the multichannel signal. In this case, task T350 may be configured to combine the mask scores of two or more (possibly all) of the frequency components in each segment to obtain a coherency measure for the segment (e.g., based on a number of mask scores having a particular state, or a sum or average of the mask scores, as described above). Such an implementation of task T350 may be configured to use the same threshold value for each segment, or to vary the threshold value over time depending on one or more factors as described above (e.g., the same principles applying to a maximum or minimum number of mask scores).

It may be desirable to configure task T350 to calculate a coherency measure for each segment based on the mask scores of all of the frequency components of the segment. Alternatively, it may be desirable to configure task T350 to calculate the coherency measure for each segment based on the mask scores of frequency components over a limited frequency range. For example, task T350 may be configured to calculate the coherency measure based on the mask scores of frequency components over a frequency range of from about fifty, 100, 200, or 300 Hz to about 500 or 1000 Hz (each of these eight combinations is expressly contemplated and disclosed). It may be decided, for example, that the differences between the response characteristics of the channels are sufficiently characterized by the difference in the gain responses of the channels over such a frequency range.

Task T340 may be configured to calculate an updated value for each of at least one gain factor based on information from the acoustically balanced portions identified by task T360. For example, it may be desirable to configure task T340 to calculate an updated gain factor value in response to an indication that the multichannel signal is directionally coherent in a corresponding segment or subband (e.g., in response to a selection of the subband or segment in task T360 as indicated by the state of the corresponding coherency indication).

Task T400 may be configured to use an updated gain factor value produced by task T300 to control the amplitude of the second channel relative to the amplitude of the first channel. As described herein, it may be desirable to configure task T300 to update the gain factor value based on an observed level imbalance of an acoustically balanced segment. For subsequent segments that are not acoustically balanced, it may be desirable for task T300 to refrain from updating the gain factor value, and for task T400 to continue to apply the most recently updated gain factor value. FIG. 12A shows a flowchart of an implementation M120 of method M100 that includes such an implementation T420 of task T400. Task T420 is configured to use the updated gain factor value to alter the amplitude of the second channel, relative to the amplitude of the first channel, in each of a series of consecutive segments of the multichannel signal (e.g., each of a series of acoustically imbalanced segments). Such a series may continue until another acoustically balanced segment is identified such that task T300 updates the gain factor value again. (The principles described in this paragraph may also be applied to the updating and application of subband gain factor values as described herein.)

Implementations of method M100 may also be configured to support various further operations on the multichannel signal and/or the processed multichannel signal, such as a spatially selective processing operation (e.g., one or more operations that determine the distance between the audio sensing device and a particular sound source, reduce noise, enhance signal components that arrive from a particular direction, and/or separate one or more sound components from other environmental sounds), which may be calibration dependent. For example, the range of applications for a balanced multichannel signal (e.g., the processed multichannel signal) includes reduction of nonstationary diffuse and/or directional noise; dereverberation of sound produced by a near-field desired speaker; removal of noise that is uncorrelated between the microphone channels (e.g., wind and/or sensor noise); suppression of sound from undesired directions; suppression of far-field signals from any direction; estimation of direct-path-to-reverberation signal strength (e.g., for significant reduction of interference from far-field sources); reduction of nonstationary noise through discrimination between near- and far-field sources; and reduction of sound from a frontal interferer during near-field desired source activity as well as during pauses, which is not typically achievable with gain-based approaches.

Figure 12B:
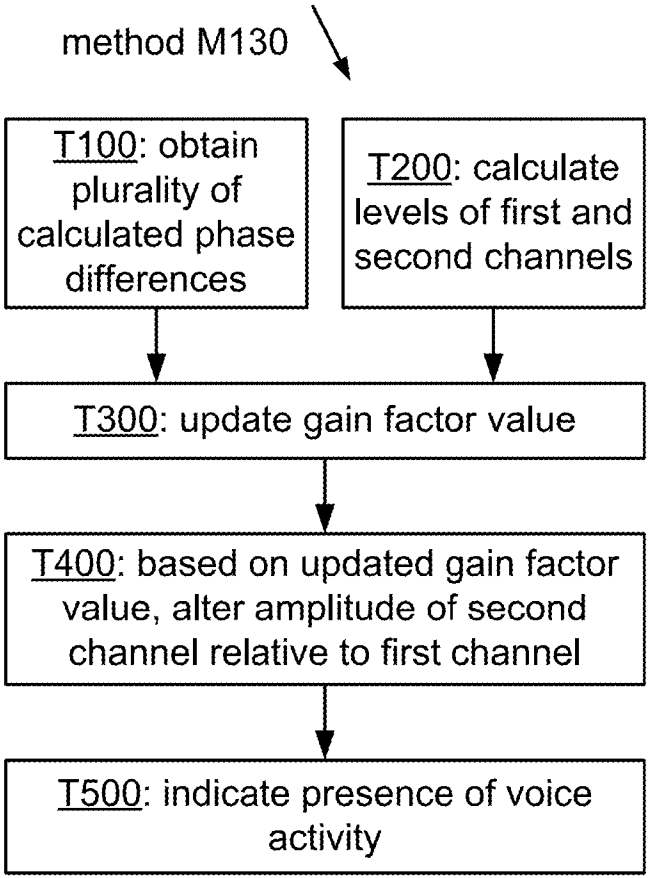
FIG. 12B shows a flowchart of an implementation M130 of method M100.
Figure 12A:
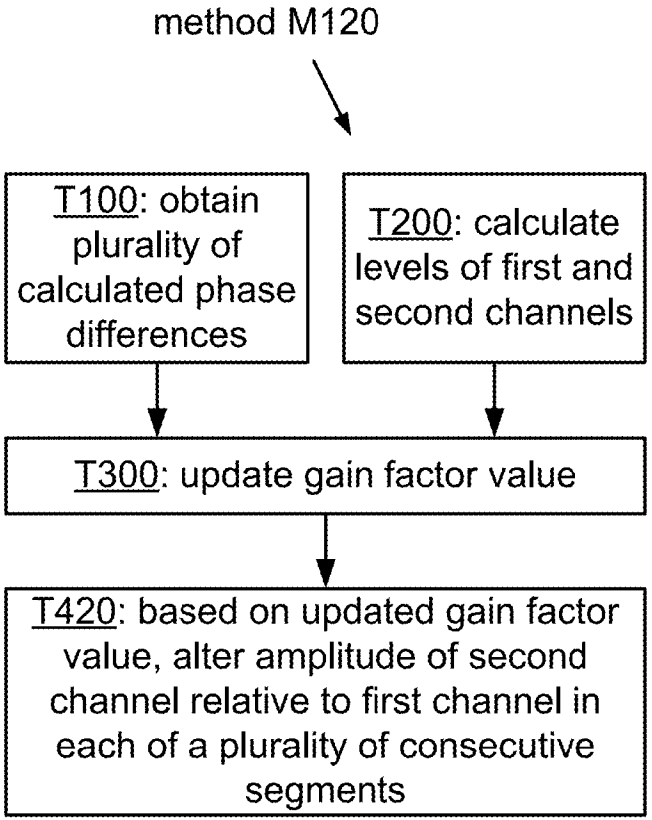
FIG. 12A shows a flowchart of an implementation M120 of method M100.

FIG. 12B shows a flowchart of an implementation M130 of method M100 that includes a task T500, which performs a voice activity detection (VAD) operation on the processed multichannel signal. FIG. 13A shows a flowchart of an implementation M140 of method M100 that includes a task T600, which updates a noise estimate based on information from the processed multichannel signal and may include a voice activity detection operation.

It may be desirable to implement a signal processing scheme that discriminates between sounds from near-field and far-field sources (e.g., for better noise reduction). One amplitude- or gain-based example of such a scheme uses a pressure gradient field between two microphones to determine whether a source is near-field or far-field. While such a technique may be useful for reducing noise from a far-field source during near-field silence, however, it may not support discrimination between near-field and far-field signals when both sources are active.

It may be desirable to provide a consistent pickup within a particular angular range. For example, it may be desirable to accept all near-field signals within a particular range (e.g., a sixty-degree range, with respect to an axis of the microphone array), and to attenuate everything else (e.g., signal from sources at seventy degrees or more). With beamforming and BSS, angular attenuation typically prevents consistent pickup across such a range. Such methods may also result in voice rejection after a change in orientation (e.g., rotation) of the device, before the post-processing operation has reconverged. Implementations of method M100 as described herein may be used to obtain noise reduction methods that are robust to sudden rotation of the device, so long as the direction to the desired speaker is still within the range of allowable directions, thus avoiding voice fluctuation due to convergence delays and/or voice attenuation due to an outdated noise reference.

By combining gain differences from the balanced multichannel signal and phase-based directional information, an adjustable spatial region can be selected around the microphone array in which the presence of signals can be monitored. Gain-based and/or directional bounds may be set to define narrow or wide pick-up regions for different subtasks. For example, a narrower bound can be set to detect desired voice activity, while a wider bound on the selected area may be used for purposes such as noise reduction. The accuracy of phase correlation and gain difference evaluations tend to decrease with decreasing SNR, and it may be desirable to adjust threshold values and/or decisions accordingly to control false alarm rates.

For an application in which the processed multichannel signal is only being used to support a voice activity detection (VAD) operation, it may be acceptable for the gain calibration to operate at a reduced level of accuracy, such that an effective and accurate noise reduction operation may be performed more quickly, with a reduced noise-reduction convergence time.

As the relative distance between a sound source and a microphone pair increases, coherence among the directions of arrival of different frequency components may be expected to decrease (e.g., due to an increase in reverberation). Therefore the coherency measure calculated in task T360 may also serve to some extent as a proximity measure. Unlike processing operations that are based only on direction of arrival, for example, time- and/or frequency-dependent amplitude control that is based on the value of a coherency measure as described herein may be effective for distinguishing speech of a user or other desired near-field source from interference, such as speech of a competing speaker, from a far-field source in the same direction. The rate at which directional coherency diminishes with distance may vary from one environment to another. The interior of an automobile is typically very reverberant, for example, such that directional coherency over a wide range of frequencies may be maintained at a reliably stable level over time within a range of only about fifty centimeters from the source. In such case, sound from a back-seat passenger may be rejected as incoherent, even if that speaker is positioned within the passband of the directional masking function. The range of detectable coherence may also be reduced in such circumstances for a tall speaker (e.g., due to reflections from the nearby ceiling).

The processed multichannel signal may be used to support other spatially selective processing (SSP) operations, such as BSS, delay-of-arrival, or other directional SSP, or distance SSP, such as proximity detection. Proximity detection may be based on a gain difference between channels. It may be desirable to calculate the gain difference in the time domain, or in the frequency domain (e.g., as a measure of coherence over a limited frequency range and/or at multiples of pitch frequency).

Multi-microphone noise reduction schemes for portable audio sensing devices include beamforming approaches and blind source separation (BSS) approaches. Such approaches typically suffer from an inability to suppress noise that arrives from the same direction as the desired sound (e.g., the voice of a near-field speaker). Especially in headsets and mid-field or far-field handheld applications (e.g., browse-talk and speakerphone modes of a handset or smartphone), the multichannel signal recorded by the microphone array may include sound from interfering noise sources and/or significant reverberation of a desired near-field talker's speech. For headsets in particular, the large distance to the user's mouth may allow the microphone array to pick up a large amount of noise from frontal directions that may be difficult to suppress significantly using only directional information.

A typical BSS or generalized sidelobe cancellation (GSC)-type technique performs noise reduction by first separating the desired voice into one microphone channel and then performing a post-processing operation on the separated voice. This procedure may lead to long convergence times in case of acoustic scenario changes. For example, noise reduction schemes based on blind source separation, GSC, or similar adaptive learning rules may exhibit long convergence times during changes in device-user holding patterns (e.g., an orientation between the device and the user's mouth) and/or rapid changes in the loudness and/or spectral signature of environmental noise (e.g., a passing car, a public address announcement). In a reverberant environment (e.g., a vehicle interior), an adaptive learning scheme may have trouble converging. Failure of such a scheme to converge may cause it to reject a desired signal component. In voice communications applications, such rejection may increase voice distortion.

In order to increase robustness of such schemes to changes in device-user holding patterns and/or to speed up convergence times, it may be desirable to limit the spatial pick-up region around a device to provide a more rapid initial noise reduction response. Such a method may be configured to exploit phase and gain relationships between microphones to define the limited spatial pick-up region by discriminate against certain angular directions (e.g., with respect to a reference direction of the device, such as an axis of the microphone array) and/or between signal components from near- and far-field sources. By having a select region around the audio device in the desired speaker direction always exhibiting a baseline initial noise reduction, a high degree of robustness to spatial changes of desired user with respect to audio device as well as rapid changes to environmental noise can be achieved.

Gain differences between balanced channels may be used for proximity detection, which may support more aggressive near-field/far-field discrimination, such as better frontal noise suppression (e.g., suppression of an interfering speaker in front of the user). Depending on the distance between microphones, a gain difference between balanced microphone channels will typically occur only if the source is within fifty centimeters or one meter.

Figure 13B:
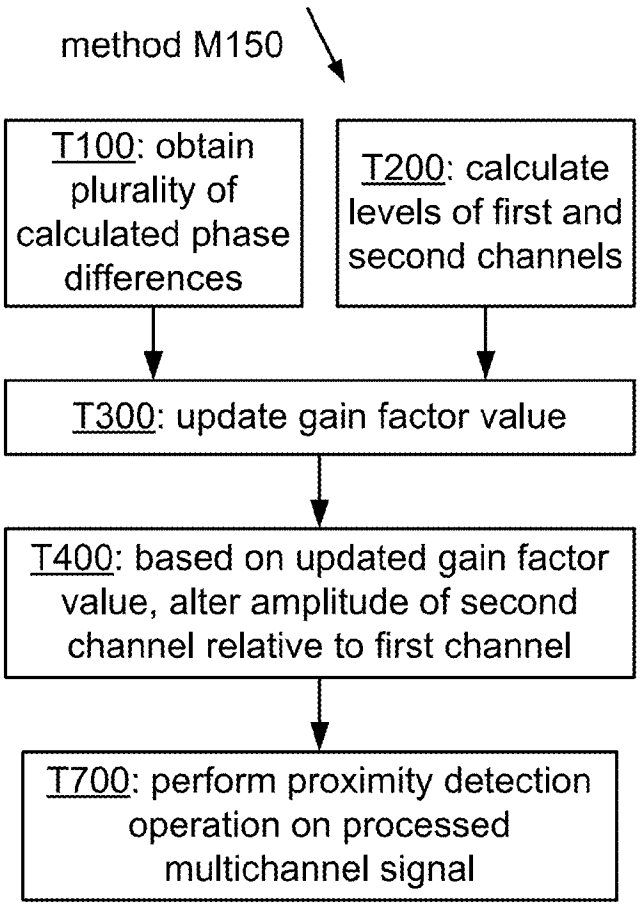
FIG. 13B shows a flowchart of an implementation M150 of method M100.
Figure 13A:
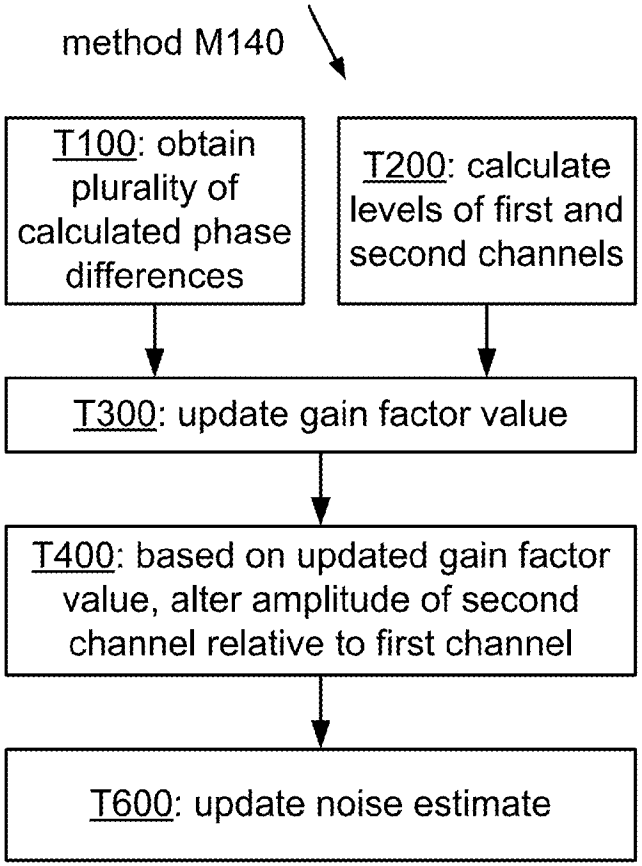
FIG. 13A shows a flowchart of an implementation M140 of method M100.
Figure 14B:
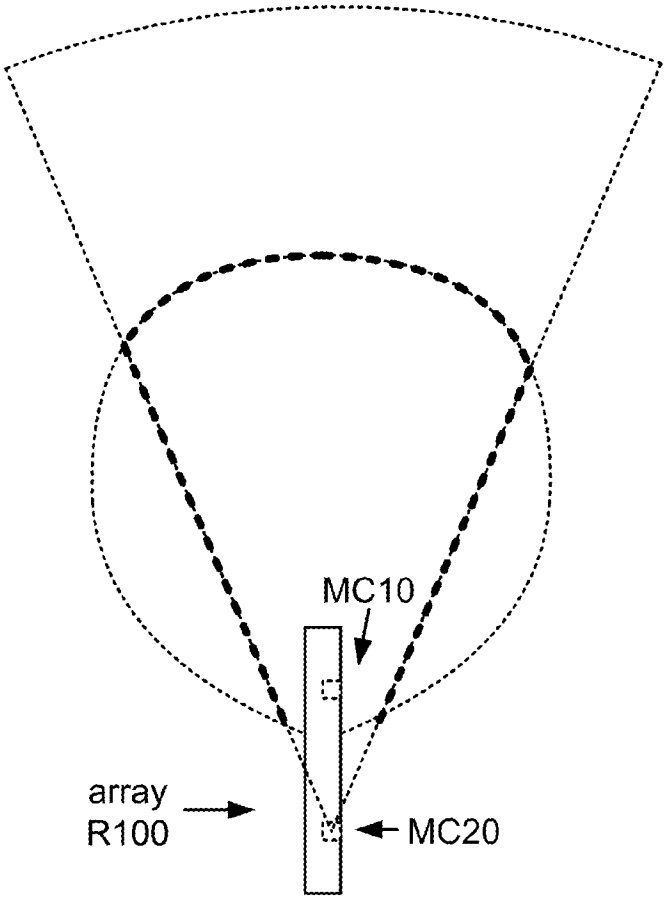
FIG. 14B shows an example of an intersection of a range of allowed directions with a proximity bubble to obtain a cone of speaker coverage.
Figure 14A:
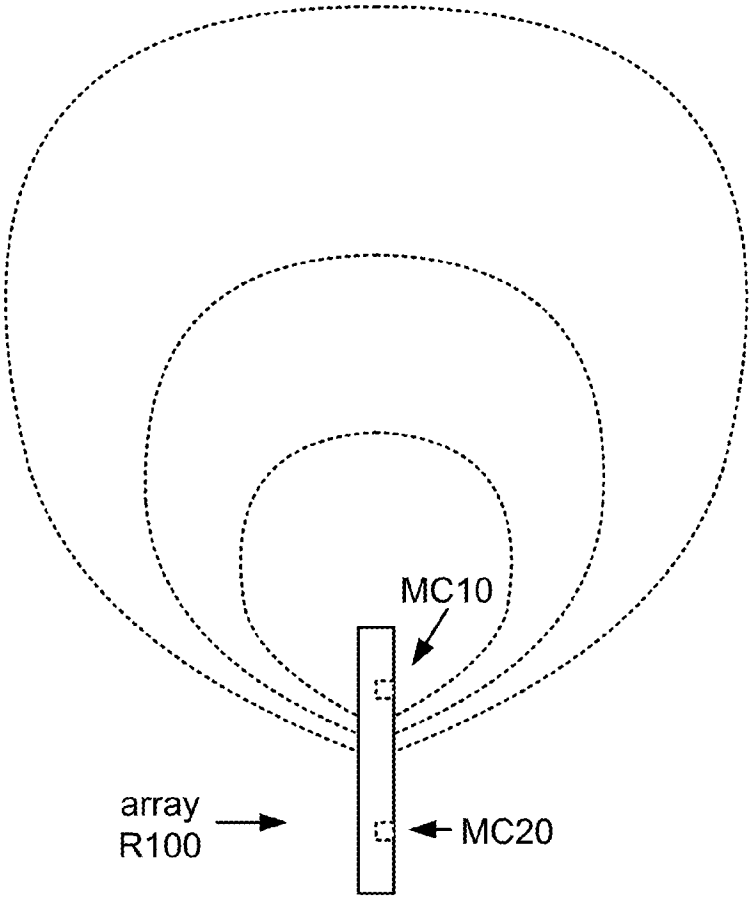
FIG. 14A shows an example of boundaries of proximity detection regions corresponding to three different threshold values.

FIG. 13B shows a flowchart of an implementation M150 of method M100. Method M150 includes a task T700 that performs a proximity detection operation on the processed multichannel signal. For example, task T700 may be configured to detect that a segment is from a desired source (e.g., to indicate detection of voice activity) when a difference between the levels of the channels of the processed multichannel signal is greater than a threshold value (alternatively, when the sum of (A) the level difference of the uncalibrated channels and (B) the gain factor value of task T300 is greater than the threshold value). The threshold value may be determined heuristically, and it may be desirable to use different threshold values depending on one or more factors such as signal-to-noise ratio (SNR), noise floor, etc. (e.g., to use a higher threshold value when the SNR is low). FIG. 14A shows an example of boundaries of proximity detection regions corresponding to three different threshold values, with the region growing smaller as the threshold value increases.

It may be desirable to combine a range of allowed directions (e.g., plus or minus forty-five degrees) with a near-field/far-field proximity bubble to obtain a cone of speaker coverage, and to attenuate nonstationary noise from sources outside this zone. Such a method may be used to attenuate sound from far-field sources even when they are within the range of allowable directions. For example, it may be desirable to provide good microphone calibration to support aggressive tuning of a near-field/far-field discriminator. FIG. 14B shows an example of an intersection (shown in bold) of a range of allowed directions (e.g., a forward lobe as shown in FIG. 10) with a proximity bubble (as shown in FIG. 14A) to obtain such a cone of speaker coverage. In such case, the plurality of phase differences calculate in task T100 may be used to enforce the range of allowed directions using a masking function (e.g., as discussed above with reference to tasks T312, T322, and T332) and/or a coherency measure (e.g., as discussed above with reference to task T360) to identify segments that originate from sources in the desired range. The direction and profile of such a masking function may be selected according to the desired application (e.g., a sharper profile for voice activity detection, or a smoother profile for attenuation of noise components).

Figure 15:
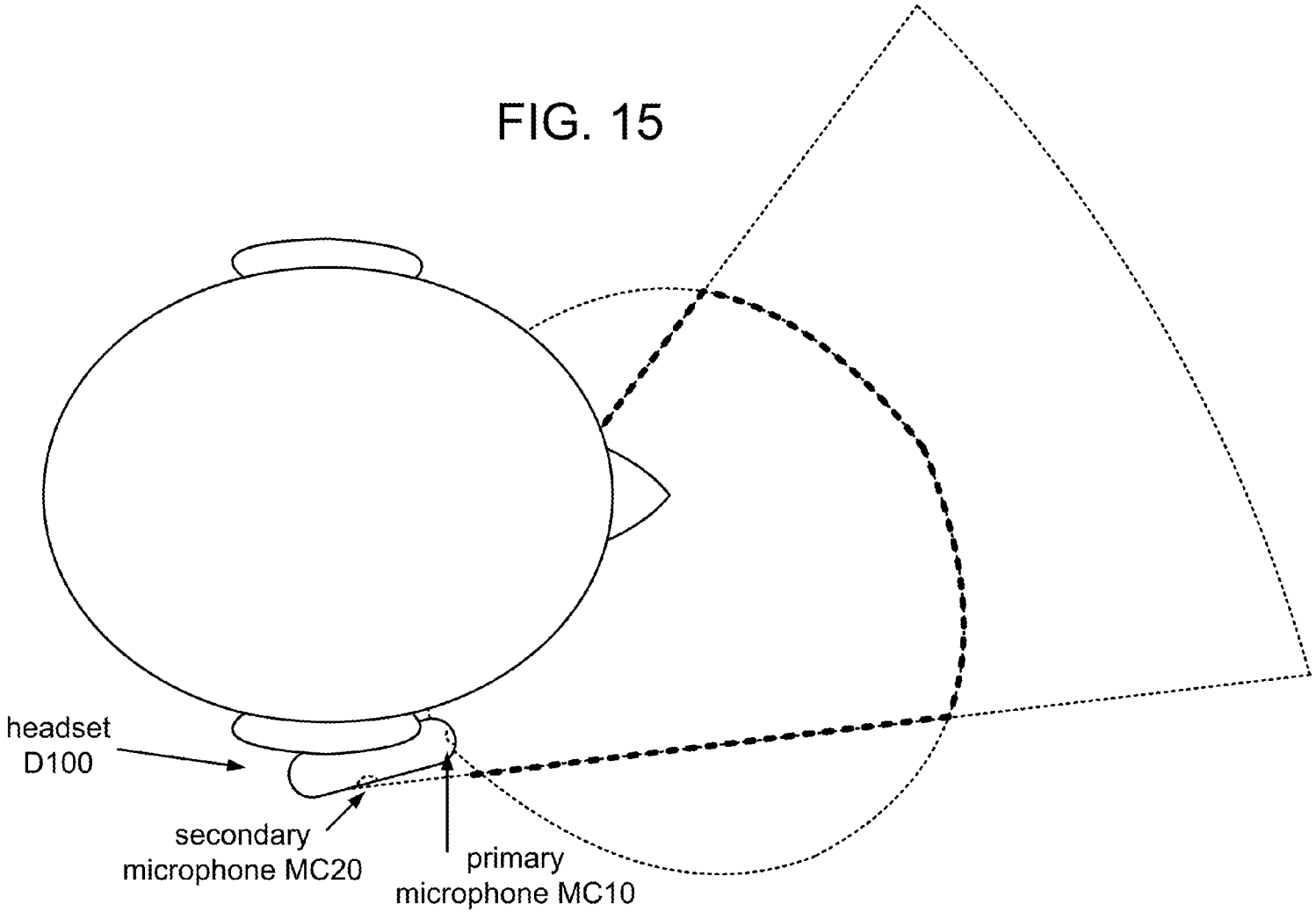
FIGS. 15 and 16 show top and side views of a source selection region boundary as shown in FIG. 14B.
Figure 16:
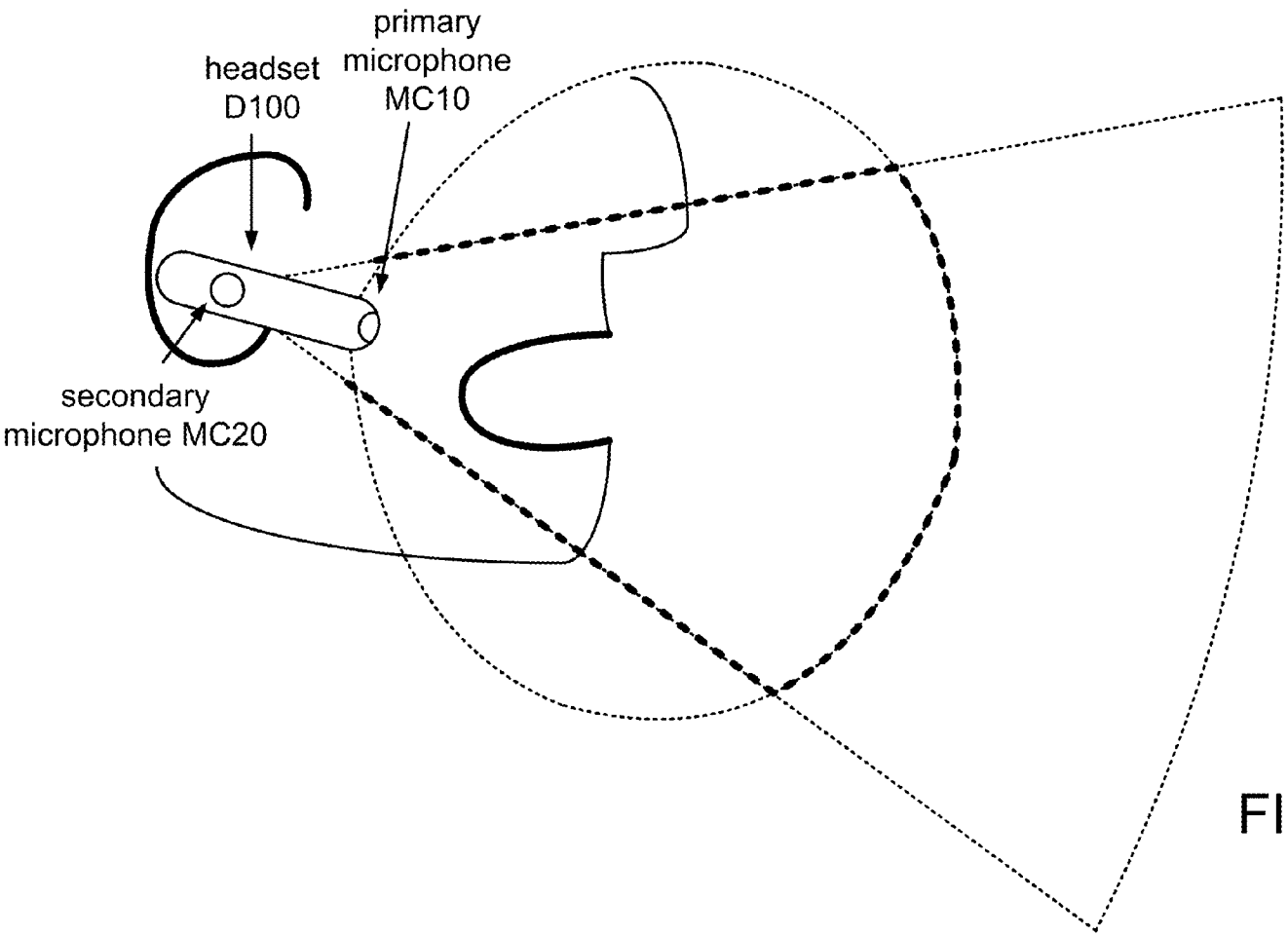

As noted above, FIG. 2 shows a top view of a headset mounted on a user's ear in a standard orientation relative to the user's mouth. FIGS. 15 and 16 show top and side views of a source selection region boundary as shown in FIG. 14B being applied to this application.

Figure 17B:
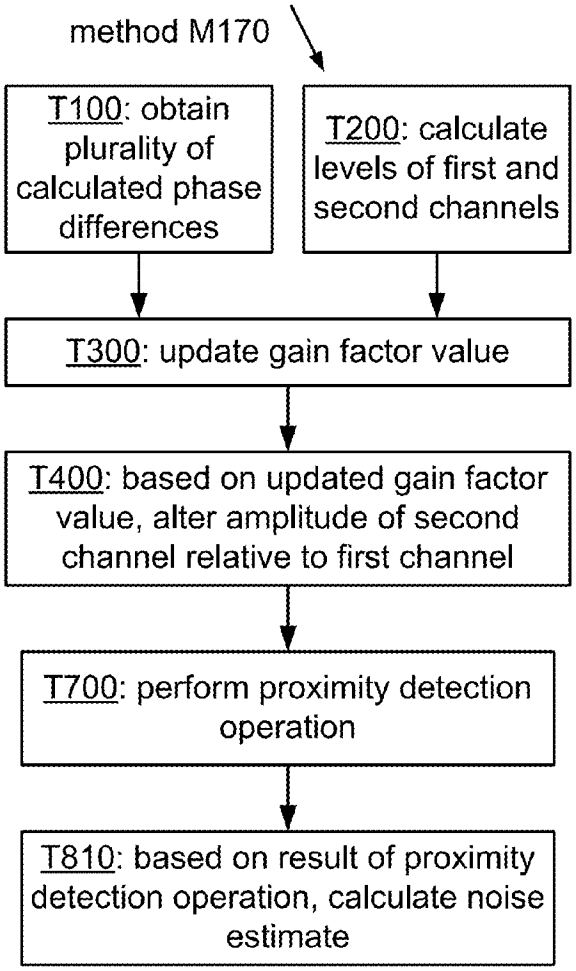
FIG. 17B shows a flowchart of an implementation M170 of method M100.
Figure 17A:
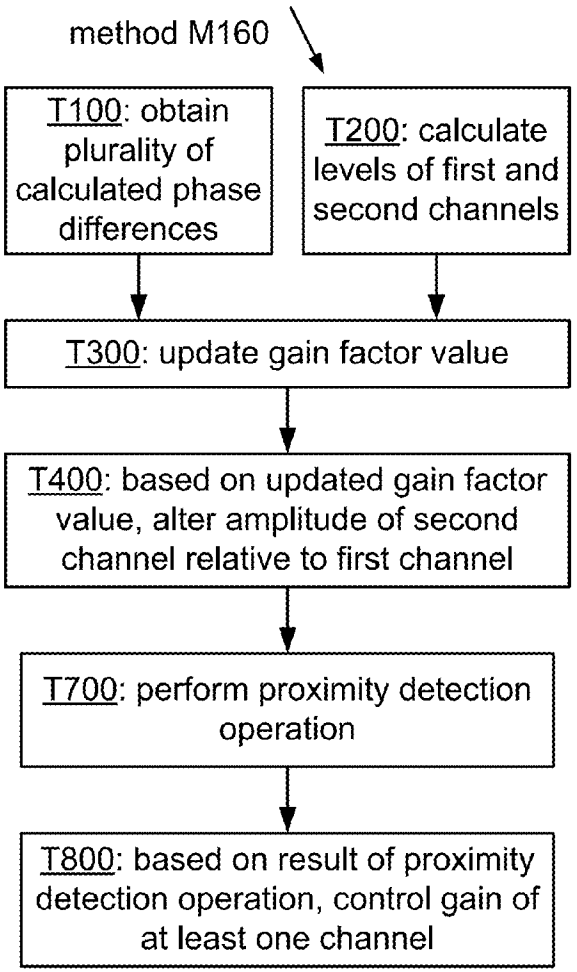
FIG. 17A shows a flowchart of an implementation M160 of method M100.
Figure 18:
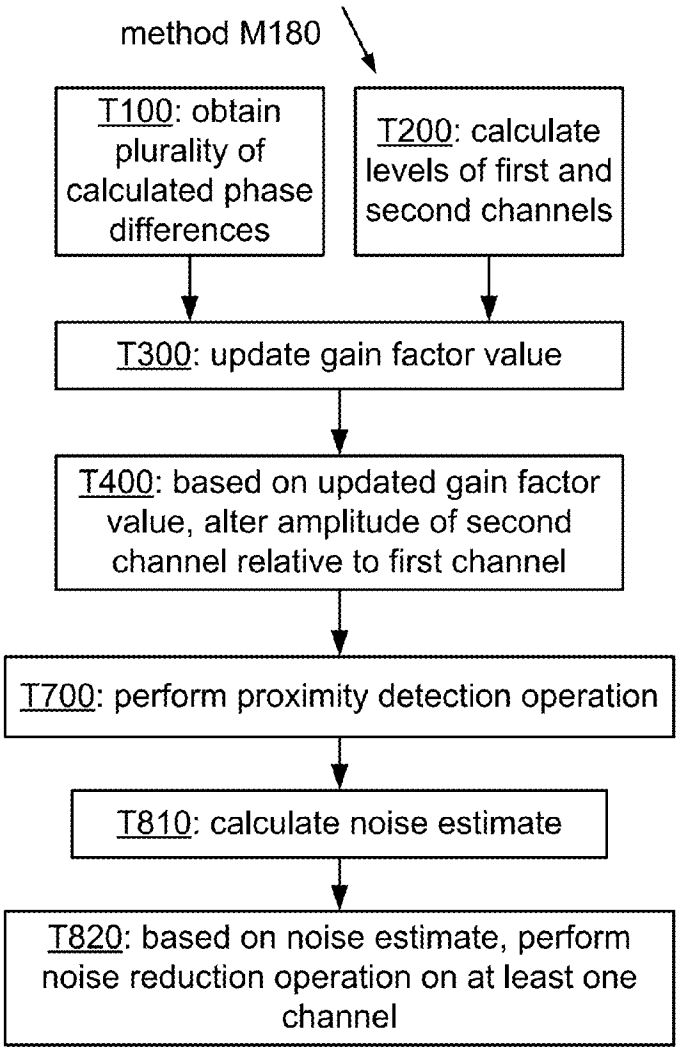
FIG. 18 shows a flowchart of an implementation M180 of method M170.

It may be desirable to use the results of a proximity detection operation (e.g., task 700) for voice activity detection (VAD). In one such example, a non-binary improved VAD measure is applied as a gain control on one or more of the channels (e.g., to attenuate noise frequency components and/or segments). FIG. 17A shows a flowchart of an implementation M160 of method M100 that includes a task T800 that performs such a gain control operation on the balanced multichannel signal. In another such example, a binary improved VAD is applied to calculate (e.g., update) a noise estimate for a noise reduction operation (e.g., using frequency components or segments that have been classified by the VAD operation as noise). FIG. 17B shows a flowchart of an implementation M170 of method M100 that includes a task T810 that calculates (e.g., updates) a noise estimate based on a result of the proximity detection operation. FIG. 18 shows a flowchart of an implementation M180 of method M170. Method M180 includes a task T820 that performs a noise reduction operation on at least one channel of the multichannel signal (e.g., a spectral subtraction or Wiener filtering operation) that is based on the updated noise estimate.

Results from a proximity detection operation and a directional coherence detection operation (e.g., defining a bubble as shown in FIG. 14B and/or FIGS. 15 and 16) may be combined to obtain an improved, multi-channel voice activity detection (VAD) operation. The combined VAD operation may be used for quick rejection of non-voice frames and/or to build a noise reduction scheme to operate on the primary microphone channel. Such a method may include calibration, combining direction and proximity information for VAD, and performing a noise reduction operation based on results of the VAD operation. For example, it may be desirable to use such a combined VAD operation in methods M160, M170 or M180 in place of proximity detection task T700.

The acoustic noise in a typical environment may include babble noise, airport noise, street noise, voices of competing talkers, and/or sounds from interfering sources (e.g., a TV set or radio). Consequently, such noise is typically nonstationary and may have an average spectrum is close to that of the user's own voice. A noise power reference signal as computed from a single microphone signal is usually only an approximate stationary noise estimate. Moreover, such computation generally entails a noise power estimation delay, such that corresponding adjustments of subband gains can only be performed after a significant delay. It may be desirable to obtain a reliable and contemporaneous estimate of the environmental noise.

Examples of noise estimates include a single-channel long-term estimate, based on a single-channel VAD, and a noise reference as produced by a multichannel BSS filter. Task T810 may be configured to calculate a single-channel noise reference by using (dual-channel) information from the proximity detection operation to classify components and/or segments of a primary microphone channel. Such a noise estimate may be available much more quickly than other approaches, as it does not require a long-term estimate. This single-channel noise reference can also capture nonstationary noise, unlike the long-term-estimate-based approach, which is typically unable to support removal of nonstationary noise. Such a method may provide a fast, accurate, and nonstationary noise reference. For example, such a method may be configured to update the noise reference for any frames that are not within a forward cone as shown in FIG. 14B. The noise reference may be smoothed (e.g., using a first-degree smoother, possibly on each frequency component). The use of proximity detection may enable a device using such a method to reject nearby transients such as the sound of noise of a car passing into the forward lobe of the directional masking function.

It may be desirable to configure task T810 to take the noise reference directly from the primary channel, rather than waiting for a multichannel BSS scheme to converge. Such a noise reference may be constructed using a combined phase-gain VAD, or just using the phase VAD. Such an approach may also help to avoid the problem of a BSS scheme attenuating the voice while it is converging to a new spatial configuration between speaker and phone, or when the handset is being used in a suboptimal spatial configuration.

A VAD indication as described above may be used to support calculation of a noise reference signal. When the VAD indication indicates that a frame is noise, for example, the frame may be used to update the noise reference signal (e.g., a spectral profile of the noise component of the primary microphone channel). Such updating may be performed in a frequency domain, for example, by temporally smoothing the frequency component values (e.g., by updating the previous value of each component with the value of the corresponding component of the current noise estimate). In one example, a Wiener filter uses the noise reference signal to perform a noise reduction operation on the primary microphone channel. In another example, a spectral subtraction operation uses the noise reference signal to perform a noise reduction operation on the primary microphone channel (e.g., by subtracting the noise spectrum from the primary microphone channel). When the VAD indication indicates that a frame is not noise, the frame may be used to update a spectral profile of the signal component of the primary microphone channel, which profile may also be used by the Wiener filter to perform the noise reduction operation. The resulting operation may be considered to be a quasi-single-channel noise reduction algorithm that makes use of a dual-channel VAD operation.

Figure 19B:
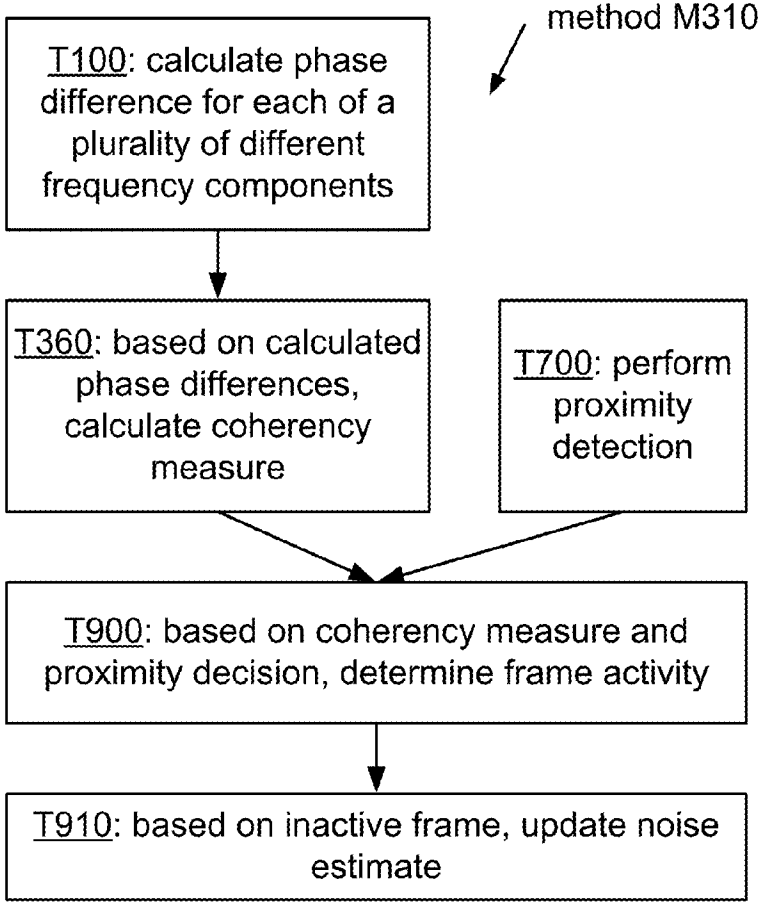
FIG. 19B shows a flowchart of an implementation M310 of method M300.
Figure 19A:
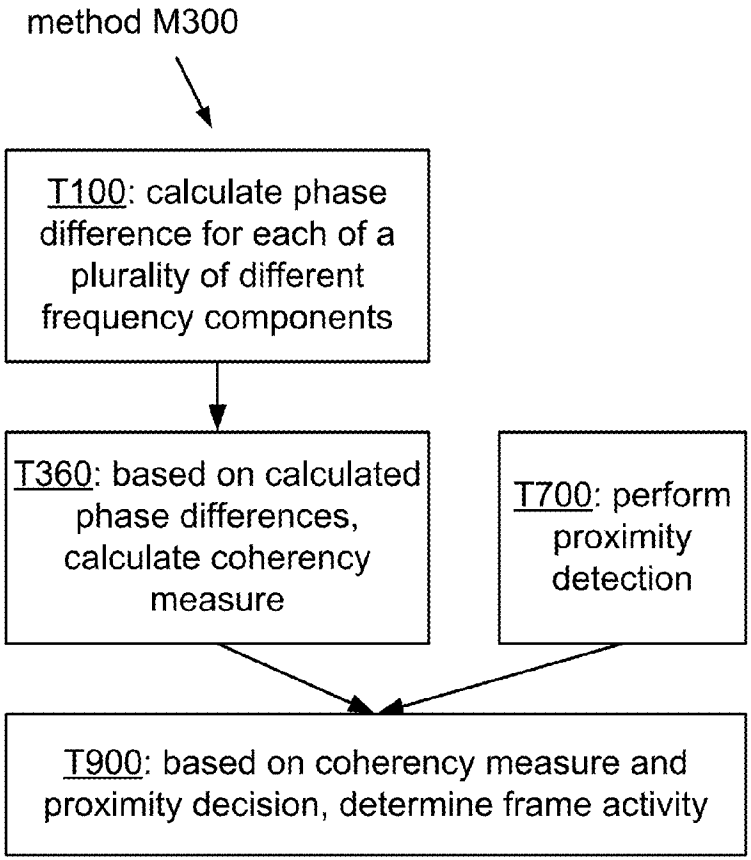
FIG. 19A shows a flowchart of a method M300 according to a general configuration.

It is expressly noted that proximity detection operations as described herein may also be applied in situations where channel calibration is not required (e.g., where the microphone channels are already balanced). FIG. 19A shows a flowchart of a method M300 according to a general configuration that includes instances of tasks T100 and T360 as described herein and a VAD operation T900 based on a coherency measure and proximity decision as described herein (e.g., a bubble as shown in FIG. 14B). FIG. 19B shows a flowchart of an implementation M310 of method M300 that includes a noise estimate calculation task T910 (e.g., as described with reference to task T810), and FIG. 20A shows a flowchart of an implementation M320 of method M310 that includes a noise reduction task T920 (e.g., as described with reference to task T820).

FIG. 20B shows a block diagram of an apparatus G100 according to a general configuration. Apparatus G100 includes means F100 for obtaining a plurality of phase differences (e.g., as described herein with reference to task T100). Apparatus G100 also includes means F200 for calculating levels of the first and second channels of the multichannel signal (e.g., as described herein with reference to task T200). Apparatus G100 also includes means F300 for updating a gain factor value (e.g., as described herein with reference to task T300). Apparatus G100 also includes means F400 for altering an amplitude of the second channel, relative to the first channel, based on the updated gain factor value (e.g., as described herein with reference to task T400).

Figure 21A:
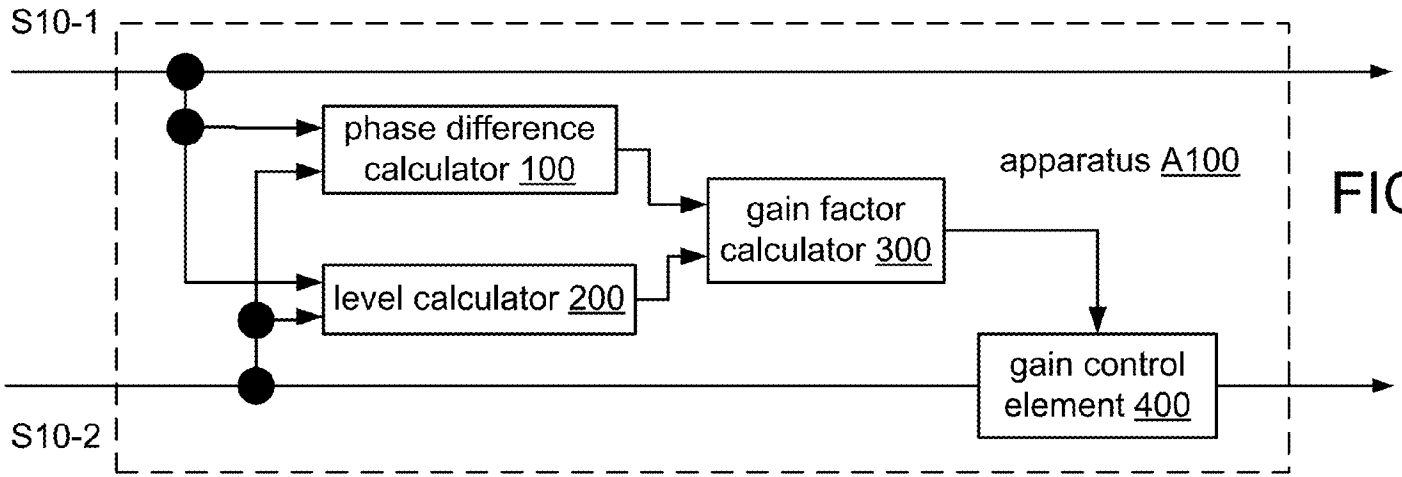
FIG. 21A shows a block diagram of an apparatus A100 according to a general configuration.

FIG. 21A shows a block diagram of an apparatus A100 according to a general configuration. Apparatus A100 includes a phase difference calculator 100 configured to obtain a plurality of phase differences from channels S10-1 and S10-2 of a multichannel signal (e.g., as described herein with reference to task T100). Apparatus A100 also includes a level calculator 200 configured to calculate levels of the first and second channels of the multichannel signal (e.g., as described herein with reference to task T200). Apparatus A100 also includes a gain factor calculator 300 configured to update a gain factor value (e.g., as described herein with reference to task T300). Apparatus A100 also includes a gain control element 400 configured to produce a processed multichannel signal by altering an amplitude of the second channel, relative to the first channel, based on the updated gain factor value (e.g., as described herein with reference to task T400).

Figure 21B:
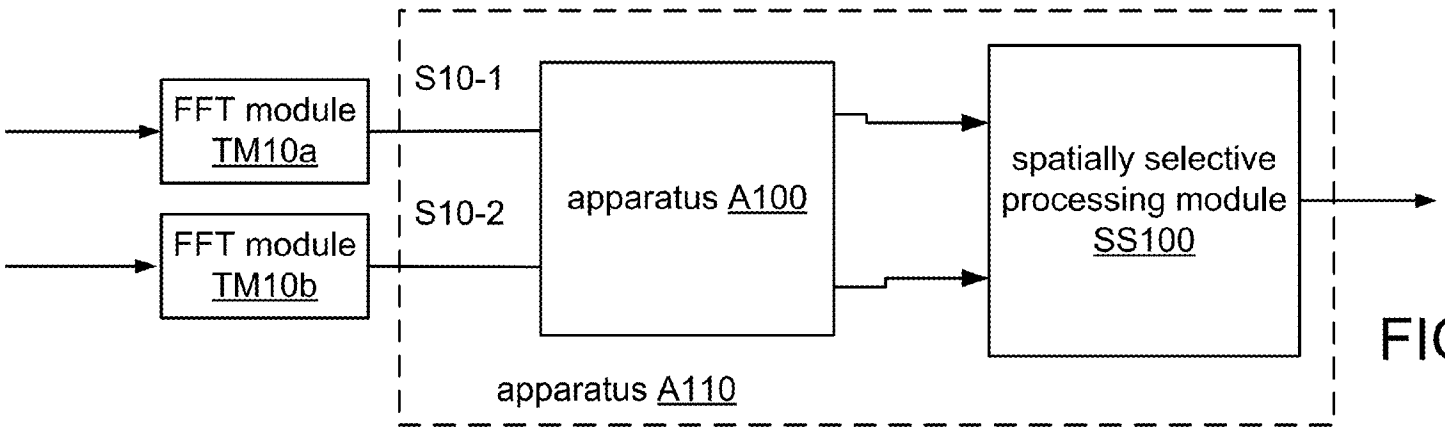
FIG. 21B shows a block diagram of an apparatus A110.
Figure 22:
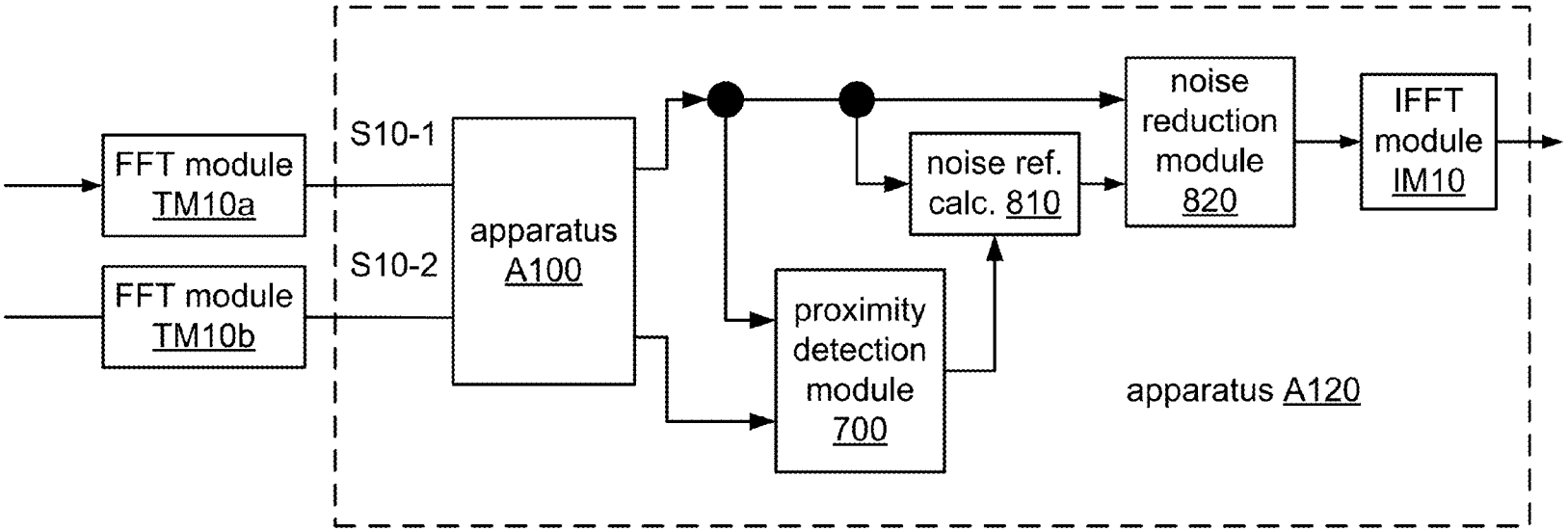
FIG. 22 shows a block diagram of an apparatus A120

FIG. 21B shows a block diagram of an apparatus A110 that includes apparatus A100; FFT modules TM10*a* and TM10*b* configured to produce signals S10-1 and S10-2, respectively, in the frequency domain; and a spatially selective processing module SS100 configured to perform a spatially selective processing operation (e.g., as described herein) on the processed multichannel signal. FIG. 22 shows a block diagram of an apparatus A120 that includes apparatus A100 and FFT modules TM10*a* and TM10*b*. Apparatus A120 also includes a proximity detection module 700 (e.g., a voice activity detector) configured to perform a proximity detection operation (e.g., a voice activity detection operation) on the processed multichannel signal (e.g., as described herein with reference to task T700), a noise reference calculator 810 configured to update a noise estimate (e.g., as described herein with reference to task T810), a noise reduction module 820 configured to perform a noise reduction operation on at least one channel of the processed multichannel signal (e.g., as described herein with reference to task T820), and an inverse FFT module IM10 configured to convert the noise-reduced signal to the time domain. In addition to or in the alternative to proximity detection module 700, apparatus A110 may include a module for directional processing of the processed multichannel signal (e.g., voice activity detection based on a forward lobe as shown in FIG. 14B).

Some multichannel signal processing operations that use information from more than one channel of a multichannel signal to produce each channel of a multichannel output. Examples of such operations may include beamforming and blind-source-separation (BSS) operations. It may be difficult to integrate echo cancellation with such a technique, as the operation tends to change the residual echo in each output channel. As described herein, method M100 may be implemented to use information from the calculate phase differences to perform single-channel time- and/or frequency-dependent amplitude control (e.g., a noise reduction operation) on each of one or more channels of the multichannel signal (e.g., on a primary channel). Such a single-channel operation may be implemented such that the residual echo remains substantially unchanged. Consequently, integration of an echo cancellation operation with an implementation of method M100 that includes such a noise reduction operation may be easier than integration of the echo cancellation operation with a noise reduction operation that operates on two or more microphone channels.

It may be desirable to whiten residual background noise. For example, it may be desirable to use a VAD operation (e.g., a directional and/or proximity-based VAD operation as described herein) to identify noise-only intervals and to compand or reduce the signal spectrum during such intervals to a noise spectral profile (e.g., a quasi-white or pink spectral profile). Such noise whitening may create a sensation of a residual stationary noise floor and/or may lead to the perception of the noise being put into or receding into the background. It may be desirable to include a smoothing scheme, such as a temporal smoothing scheme, to handle transitions between intervals during which no whitening is applied (e.g., speech intervals) and intervals during which whitening is applied (e.g., noise intervals). Such smoothing may help to support smooth transitions between intervals.

It is expressly noted that the microphones (e.g., MC10 and MC20) may be implemented more generally as transducers sensitive to radiations or emissions other than sound. In one such example, the microphone pair is implemented as a pair of ultrasonic transducers (e.g., transducers sensitive to acoustic frequencies greater than fifteen, twenty, twenty-five, thirty, forty, or fifty kilohertz or more).

For directional signal processing applications (e.g., identifying a forward lobe as shown in FIG. 14B), it may be desirable to target specific frequency components, or a specific frequency range, across which a speech signal (or other desired signal) may be expected to be directionally coherent. It may be expected that background noise, such as directional noise (e.g., from sources such as automobiles) and/or diffuse noise, will not be directionally coherent over the same range. Speech tends to have low power in the range from four to eight kilohertz, so it may be desirable to determine directional coherence with reference to frequencies of not more than four kilohertz. For example, it may be desirable to determine directional coherency over a range of from about seven hundred hertz to about two kilohertz.

As noted above, it may be desirable to configure task T360 to calculate the coherency measure based on phase differences of frequency components over a limited frequency range. Additionally or alternatively, it may be desirable to configure task T360 and/or another directional processing task (especially for speech applications, such as defining a forward lobe as shown in FIG. 14B) to calculate the coherency measure based on frequency components at multiples of the pitch frequency.

The energy spectrum of voiced speech (e.g., vowel sounds) tends to have local peaks at harmonics of the pitch frequency. The energy spectrum of background noise, on the other hand, tends to be relatively unstructured. Consequently, components of the input channels at harmonics of the pitch frequency may be expected to have a higher signal-to-noise ratio (SNR) than other components. For a directional processing task for a speech processing application of method M100 (e.g., a voice activity detection application), it may be desirable to configure the task (for example, to configure the forward lobe identification task) to consider only phase differences which correspond to multiples of an estimated pitch frequency.

Typical pitch frequencies range from about 70 to 100 Hz for a male speaker to about 150 to 200 Hz for a female speaker. The current pitch frequency may be estimated by calculating the pitch period as the distance between adjacent pitch peaks (e.g., in a primary microphone channel). A sample of an input channel may be identified as a pitch peak based on a measure of its energy (e.g., based on a ratio between sample energy and frame average energy) and/or a measure of how well a neighborhood of the sample is correlated with a similar neighborhood of a known pitch peak. A pitch estimation procedure is described, for example, in section 4.6.3 (pp. 4-44 to 4-49) of EVRC (Enhanced Variable Rate Codec) document C.S0014-C, available online at www-dot-3gpp-dot-org. A current estimate of the pitch frequency (e.g., in the form of an estimate of the pitch period or "pitch lag") will typically already be available in applications that include speech encoding and/or decoding (e.g., voice communications using codecs that include pitch estimation, such as code-excited linear prediction (CELP) and prototype waveform interpolation (PWI)).

By considering only those phase differences that correspond to multiples of the pitch frequency, the number of phase differences to be considered may be considerably reduced. Moreover, it may be expected that the frequency coefficients from which these selected phase differences are calculated will have high SNRs relative to other frequency coefficients within the frequency range being considered. In a more general case, other signal characteristics may also be considered. For example, it may be desirable to configure the directional processing task such that at least twenty-five, fifty, or seventy-five percent of the calculated phase differences correspond to multiples of an estimated pitch frequency. The same principle may be applied to other desired harmonic signals as well.

As noted above, it may be desirable to produce a portable audio sensing device that has an array R100 of two or more microphones configured to receive acoustic signals. Examples of a portable audio sensing device that may be implemented to include such an array and may be used for audio recording and/or voice communications applications include a telephone handset (e.g., a cellular telephone handset); a wired or wireless headset (e.g., a Bluetooth headset); a handheld audio and/or video recorder; a personal media player configured to record audio and/or video content; a personal digital assistant (PDA) or other handheld computing device; and a notebook computer, laptop computer, netbook computer, or other portable computing device.

Each microphone of array R100 may have a response that is omnidirectional, bidirectional, or unidirectional (e.g., cardioid). The various types of microphones that may be used in array R100 include (without limitation) piezoelectric microphones, dynamic microphones, and electret microphones. In a device for portable voice communications, such as a handset or headset, the center-to-center spacing between adjacent microphones of array R100 is typically in the range of from about 1.5 cm to about 4.5 cm, although a larger spacing (e.g., up to 10 or 15 cm) is also possible in a device such as a handset. In a hearing aid, the center-to-center spacing between adjacent microphones of array R100 may be as little as about 4 or 5 mm. The microphones of array R100 may be arranged along a line or, alternatively, such that their centers lie at the vertices of a two-dimensional (e.g., triangular) or three-dimensional shape.

During the operation of a multi-microphone audio sensing device (e.g., device D100, D200, D300, D400, D500, or D600 as described herein), array R100 produces a multichannel signal in which each channel is based on the response of a corresponding one of the microphones to the acoustic environment. One microphone may receive a particular sound more directly than another microphone, such that the corresponding channels differ from one another to provide collectively a more complete representation of the acoustic environment than can be captured using a single microphone.

Figure 23A:
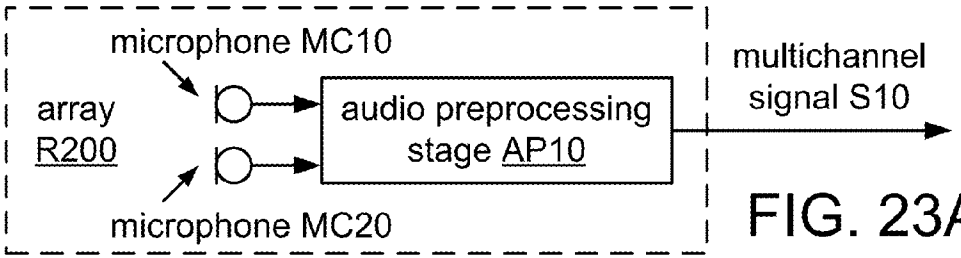
FIG. 23A shows a block diagram of an implementation R200 of array R100.

It may be desirable for array R100 to perform one or more processing operations on the signals produced by the microphones to produce multichannel signal S10. FIG. 23A shows a block diagram of an implementation R200 of array R100 that includes an audio preprocessing stage AP10 configured to perform one or more such operations, which may include (without limitation) impedance matching, analog-to-digital conversion, gain control, and/or filtering in the analog and/or digital domains.

Figure 23B:
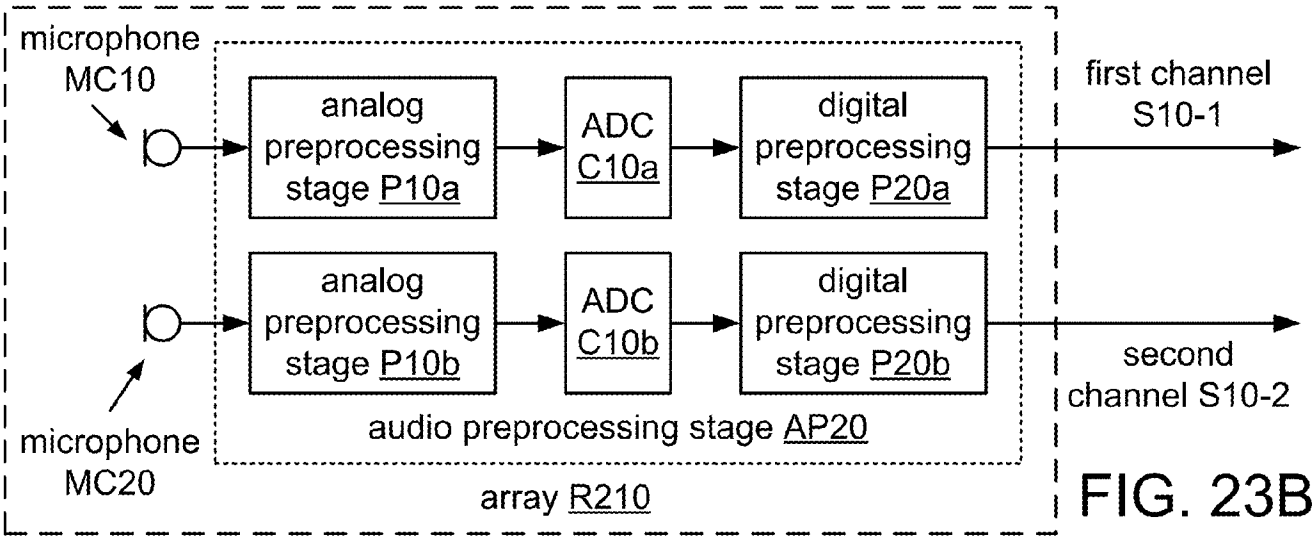
FIG. 23B shows a block diagram of an implementation R210 of array R200.

FIG. 23B shows a block diagram of an implementation R210 of array R200. Array R210 includes an implementation AP20 of audio preprocessing stage AP10 that includes analog preprocessing stages P10*a* and P10*b*. In one example, stages P10*a* and P10*b* are each configured to perform a highpass filtering operation (e.g., with a cutoff frequency of 50, 100, or 200 Hz) on the corresponding microphone signal.

It may be desirable for array R100 to produce the multichannel signal as a digital signal, that is to say, as a sequence of samples. Array R210, for example, includes analog-to-digital converters (ADCs) C10*a* and C10*b* that are each arranged to sample the corresponding analog channel. Typical sampling rates for acoustic applications include 8 kHz, 12 kHz, 16 kHz, and other frequencies in the range of from about 8 to about 16 kHz, although sampling rates as high as about 44 kHz may also be used. In this particular example, array R210 also includes digital preprocessing stages P20*a* and P20*b* that are each configured to perform one or more preprocessing operations (e.g., echo cancellation, noise reduction, and/or spectral shaping) on the corresponding digitized channel.

It is expressly noted that the microphones of array R100 may be implemented more generally as transducers sensitive to radiations or emissions other than sound. In one such example, the microphones of array R100 are implemented as ultrasonic transducers (e.g., transducers sensitive to acoustic frequencies greater than fifteen, twenty, twenty-five, thirty, forty, or fifty kilohertz or more).

Figure 24A:
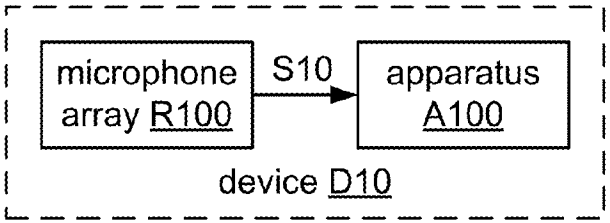
FIG. 24A shows a block diagram of a device D10 according to a general configuration.

FIG. 24A shows a block diagram of a device D10 according to a general configuration. Device D10 includes an instance of any of the implementations of microphone array R100 disclosed herein, and any of the audio sensing devices disclosed herein may be implemented as an instance of device D10. Device D10 also includes an instance of an implementation of apparatus A10 that is configured to process a multichannel signal, as produced by array R100, to calculate a value of a coherency measure. For example, apparatus A10 may be configured to process a multichannel audio signal according to an instance of any of the implementations of method M100 disclosed herein. Apparatus A10 may be implemented in hardware and/or in software (e.g., firmware). For example, apparatus A10 may be implemented on a processor of device D10 that is also configured to perform a spatial processing operation as described above on the processed multichannel signal (e.g., one or more operations that determine the distance between the audio sensing device and a particular sound source, reduce noise, enhance signal components that arrive from a particular direction, and/or separate one or more sound components from other environmental sounds). Apparatus A100 as described above may be implemented as an instance of apparatus A10.

Figure 24B:
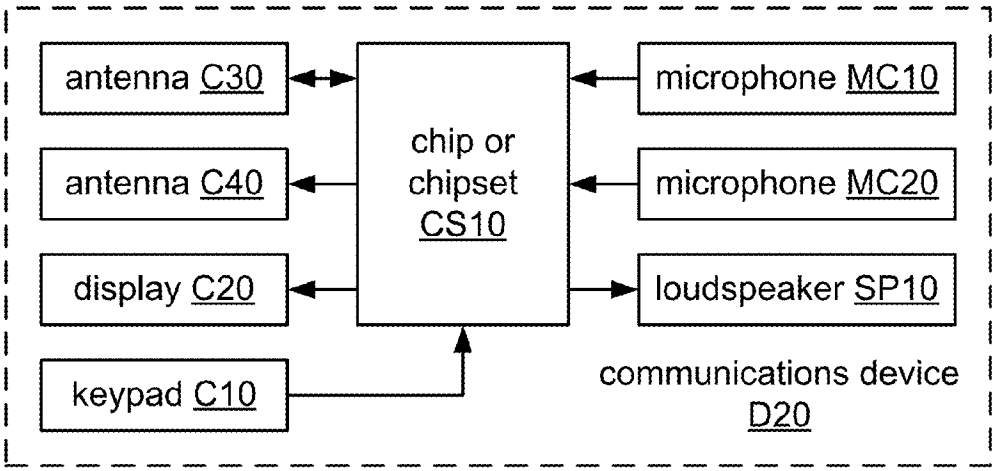
FIG. 24B shows a block diagram of an implementation D20 of device D10.

FIG. 24B shows a block diagram of a communications device D20 that is an implementation of device D10. Device D20 includes a chip or chipset CS10 (e.g., a mobile station modem (MSM) chipset) that includes apparatus A10. Chip/chipset CS10 may include one or more processors, which may be configured to execute all or part of apparatus A10 (e.g., as instructions). Chip/chipset CS10 may also include processing elements of array R100 (e.g., elements of audio preprocessing stage AP10). Chip/chipset CS10 includes a receiver, which is configured to receive a radio-frequency (RF) communications signal and to decode and reproduce an audio signal encoded within the RF signal, and a transmitter, which is configured to encode an audio signal that is based on a processed signal produced by apparatus A10 and to transmit an RF communications signal that describes the encoded audio signal. For example, one or more processors of chip/chipset CS10 may be configured to perform a noise reduction operation as described above on one or more channels of the multichannel signal such that the encoded audio signal is based on the noise-reduced signal.

Device D20 is configured to receive and transmit the RF communications signals via an antenna C30. Device D20 may also include a diplexer and one or more power amplifiers in the path to antenna C30. Chip/chipset CS10 is also configured to receive user input via keypad C10 and to display information via display C20. In this example, device D20 also includes one or more antennas C40 to support Global Positioning System (GPS) location services and/or short-range communications with an external device such as a wireless (e.g., Bluetooth™) headset. In another example, such a communications device is itself a Bluetooth headset and lacks keypad C10, display C20, and antenna C30.

Implementations of apparatus A10 as described herein may be embodied in a variety of audio sensing devices, including headsets and handsets. One example of a handset implementation includes a front-facing dual-microphone implementation of array R100 having a 6.5-centimeter spacing between the microphones. Implementation of a dual-microphone masking approach may include directly analyzing phase relationships of microphone pairs in spectrograms and masking time-frequency points from undesired directions.

Figure 25B:
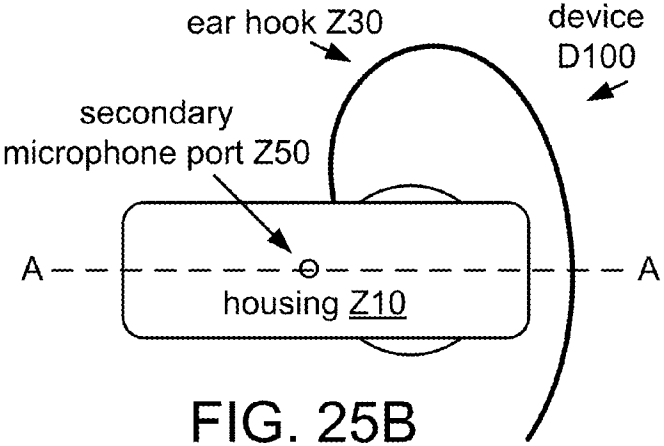
FIGS. 25A to 25D show various views of a multi-microphone wireless headset D100.
Figure 25A:
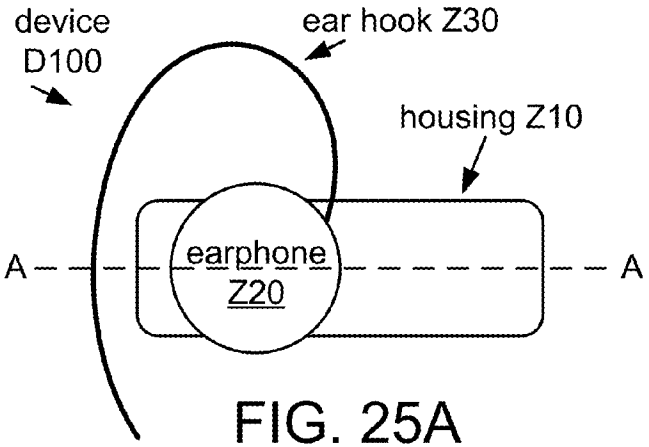
Figure 25D:
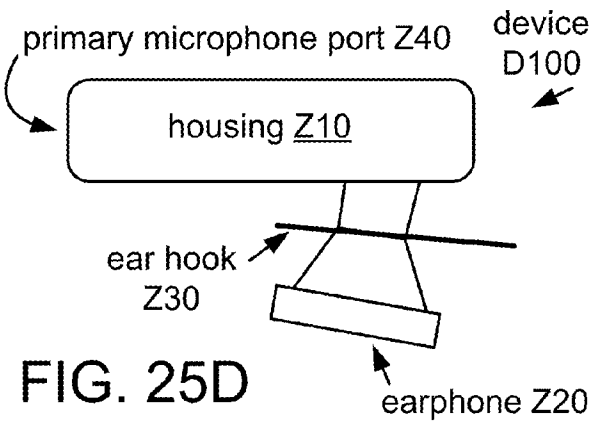

FIGS. 25A to 25D show various views of a multi-microphone portable audio sensing implementation D100 of device D10. Device D100 is a wireless headset that includes a housing Z10 which carries a two-microphone implementation of array R100 and an earphone Z20 that extends from the housing. Such a device may be configured to support half- or full-duplex telephony via communication with a telephone device such as a cellular telephone handset (e.g., using a version of the Bluetooth™ protocol as promulgated by the Bluetooth Special Interest Group, Inc., Bellevue, Wash.). In general, the housing of a headset may be rectangular or otherwise elongated as shown in FIGS. 25A, 25B, and 25D (e.g., shaped like a miniboom) or may be more rounded or even circular. The housing may also enclose a battery and a processor and/or other processing circuitry (e.g., a printed circuit board and components mounted thereon) and may include an electrical port (e.g., a mini-Universal Serial Bus (USB) or other port for battery charging) and user interface features such as one or more button switches and/or LEDs. Typically the length of the housing along its major axis is in the range of from one to three inches.

Figure 25C:
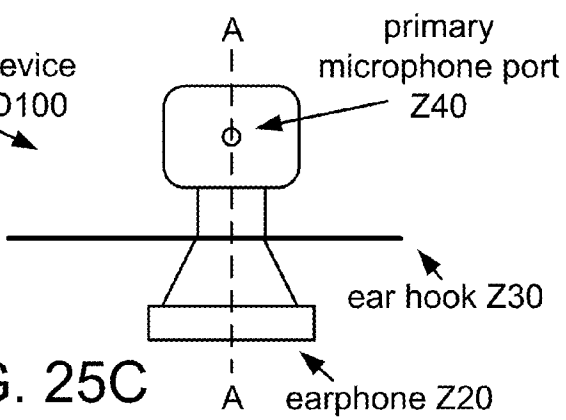
Figure 26A:
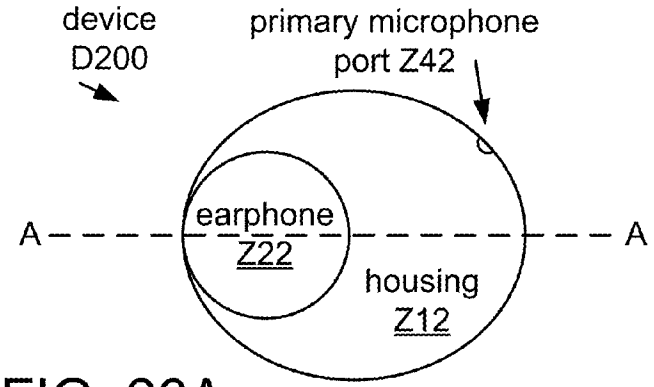
FIGS. 26A to 26D show various views of a multi-microphone wireless headset D200.
Figure 26B:
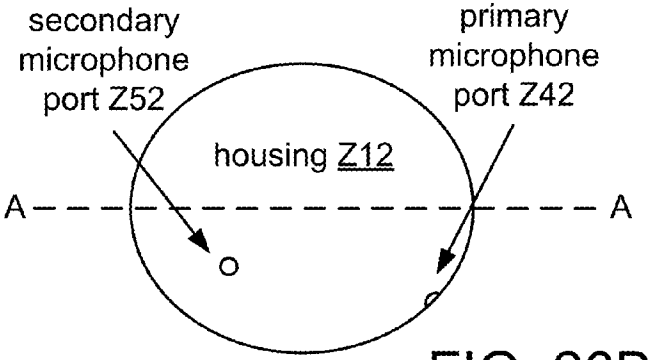
Figure 26C:
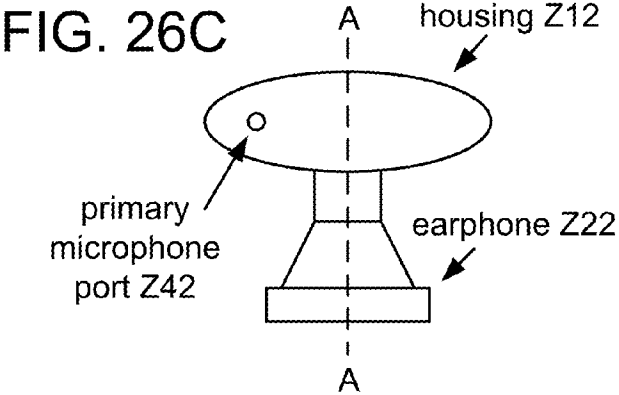
Figure 26D:
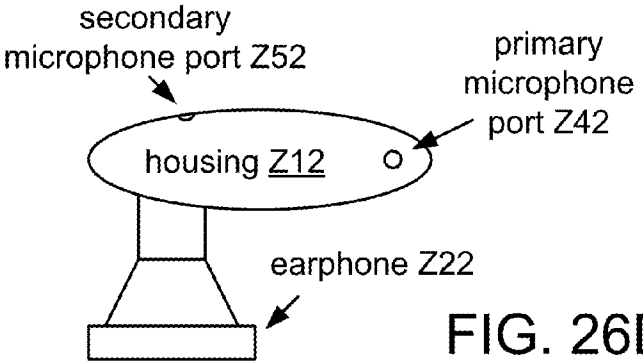

Typically each microphone of array R100 is mounted within the device behind one or more small holes in the housing that serve as an acoustic port. FIGS. 25B to 25D show the locations of the acoustic port Z40 for the primary microphone of the array of device D100 and the acoustic port Z50 for the secondary microphone of the array of device D100.

A headset may also include a securing device, such as ear hook Z30, which is typically detachable from the headset. An external ear hook may be reversible, for example, to allow the user to configure the headset for use on either ear. Alternatively, the earphone of a headset may be designed as an internal securing device (e.g., an earplug) which may include a removable earpiece to allow different users to use an earpiece of different size (e.g., diameter) for better fit to the outer portion of the particular user's ear canal.

FIGS. 26A to 26D show various views of a multi-microphone portable audio sensing implementation D200 of device D10 that is another example of a wireless headset. Device D200 includes a rounded, elliptical housing Z12 and an earphone Z22 that may be configured as an earplug. FIGS. 26A to 26D also show the locations of the acoustic port Z42 for the primary microphone and the acoustic port Z52 for the secondary microphone of the array of device D200. It is possible that secondary microphone port Z52 may be at least partially occluded (e.g., by a user interface button).

Figure 27A:
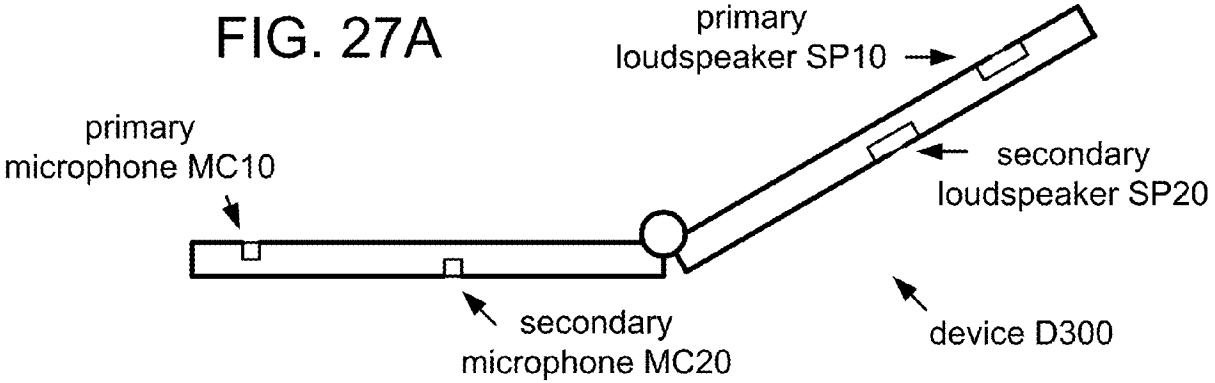
FIG. 27A shows a cross-sectional view (along a central axis) of a multi-microphone communications handset D300.
Figure 27B:
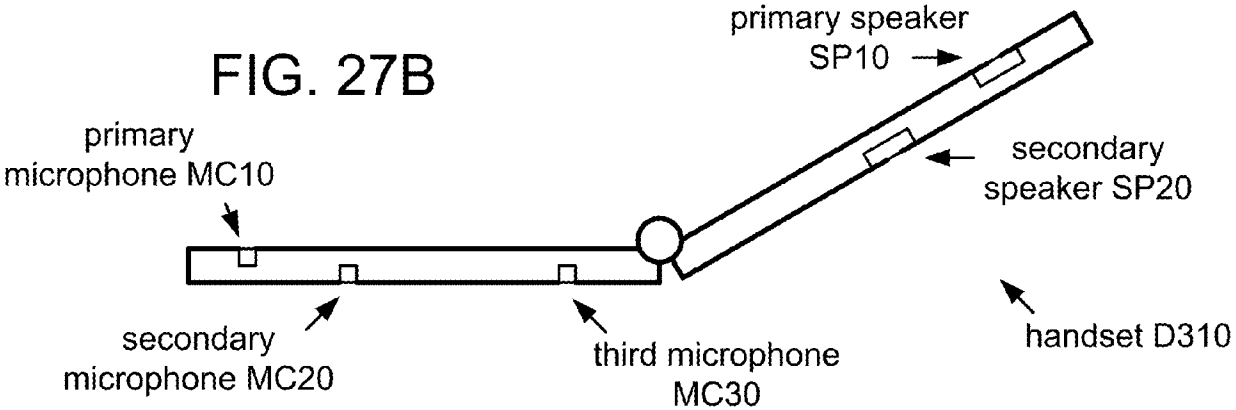
FIG. 27B shows a cross-sectional view of an implementation D310 of device D300.

FIG. 27A shows a cross-sectional view (along a central axis) of a multi-microphone portable audio sensing implementation D300 of device D10 that is a communications handset. Device D300 includes an implementation of array R100 having a primary microphone MC10 and a secondary microphone MC20. In this example, device D300 also includes a primary loudspeaker SP10 and a secondary loudspeaker SP20. Such a device may be configured to transmit and receive voice communications data wirelessly via one or more encoding and decoding schemes (also called "codecs"). Examples of such codecs include the Enhanced Variable Rate Codec, as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems," January 2004 (available online at www-dot-3gpp-dot-org); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004). In the example of FIG. 3A, handset D300 is a clamshell-type cellular telephone handset (also called a "flip" handset). Other configurations of such a multi-microphone communications handset include bar-type and slider-type telephone handsets. FIG. 27B shows a cross-sectional view of an implementation D310 of device D300 that includes a three-microphone implementation of array R100 that includes a third microphone MC30.

Figure 28C:
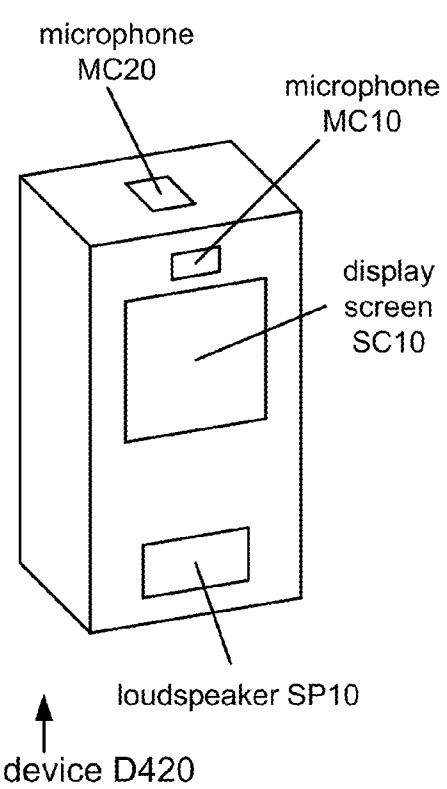
FIG. 28C shows a further implementation D420 of device D400 in which microphones MC10 and MC20 are disposed at adjacent faces of the device.
Figure 28B:
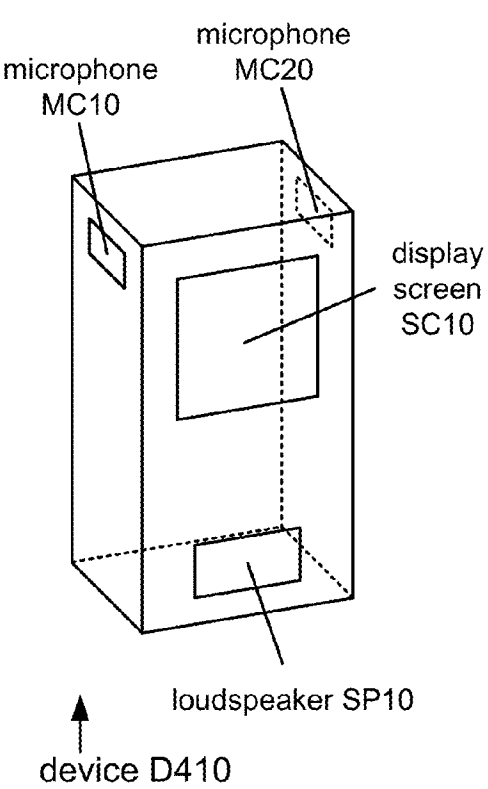
FIG. 28B shows another implementation D410 of device D400 in which microphones MC10 and MC20 are disposed at opposite faces of the device.
Figure 28A:
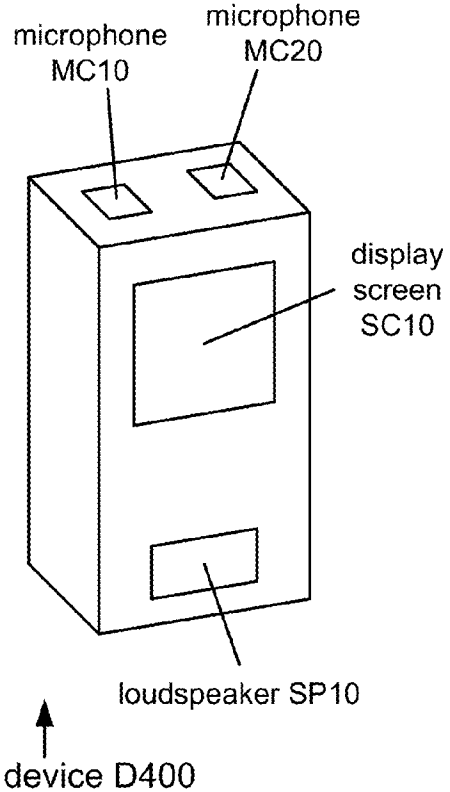
FIG. 28A shows a diagram of a multi-microphone media player D400.

FIG. 28A shows a diagram of a multi-microphone portable audio sensing implementation D400 of device D10 that is a media player. Such a device may be configured for playback of compressed audio or audiovisual information, such as a file or stream encoded according to a standard compression format (e.g., Moving Pictures Experts Group (MPEG)-1 Audio Layer 3 (MP3), MPEG-4 Part 14 (MP4), a version of Windows Media Audio/Video (WMA/WMV) (Microsoft Corp., Redmond, Wash.), Advanced Audio Coding (AAC), International Telecommunication Union (ITU)-T H.264, or the like). Device D400 includes a display screen SC10 and a loudspeaker SP10 disposed at the front face of the device, and microphones MC10 and MC20 of array R100 are disposed at the same face of the device (e.g., on opposite sides of the top face as in this example, or on opposite sides of the front face). FIG. 28B shows another implementation D410 of device D400 in which microphones MC10 and MC20 are disposed at opposite faces of the device, and FIG. 28C shows a further implementation D420 of device D400 in which microphones MC10 and MC20 are disposed at adjacent faces of the device. A media player may also be designed such that the longer axis is horizontal during an intended use.

Figure 29:
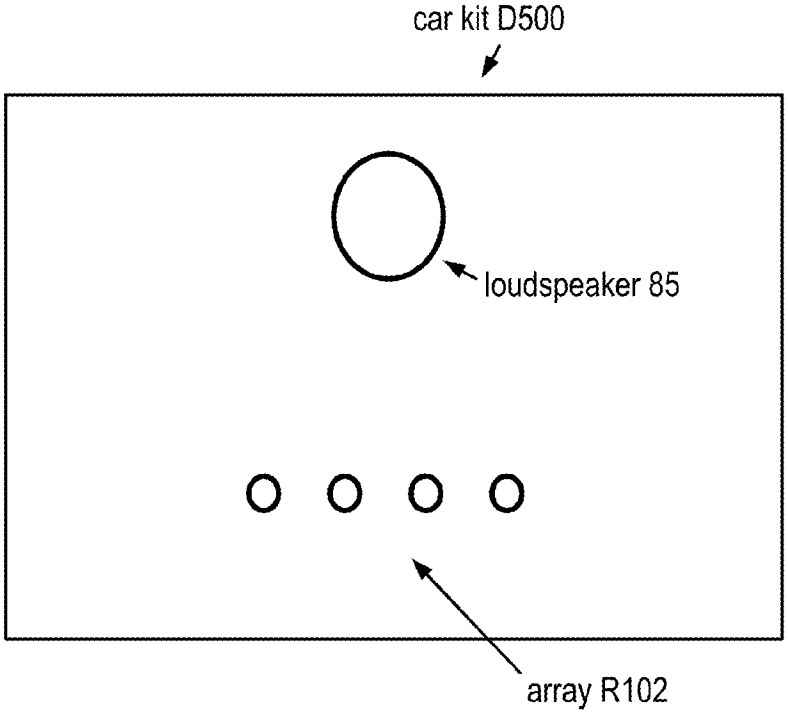
FIG. 29 shows a diagram of a multi-microphone hands-free car kit D500.

FIG. 29 shows a diagram of a multi-microphone portable audio sensing implementation D500 of device D10 that is a hands-free car kit. Such a device may be configured to be installed in or on or removably fixed to the dashboard, the windshield, the rear-view mirror, a visor, or another interior surface of a vehicle. Device D500 includes a loudspeaker 85 and an implementation of array R100. In this particular example, device D500 includes an implementation R102 of array R100 as four microphones arranged in a linear array. Such a device may be configured to transmit and receive voice communications data wirelessly via one or more codecs, such as the examples listed above. Alternatively or additionally, such a device may be configured to support half- or full-duplex telephony via communication with a telephone device such as a cellular telephone handset (e.g., using a version of the Bluetooth™ protocol as described above).

Figure 30:
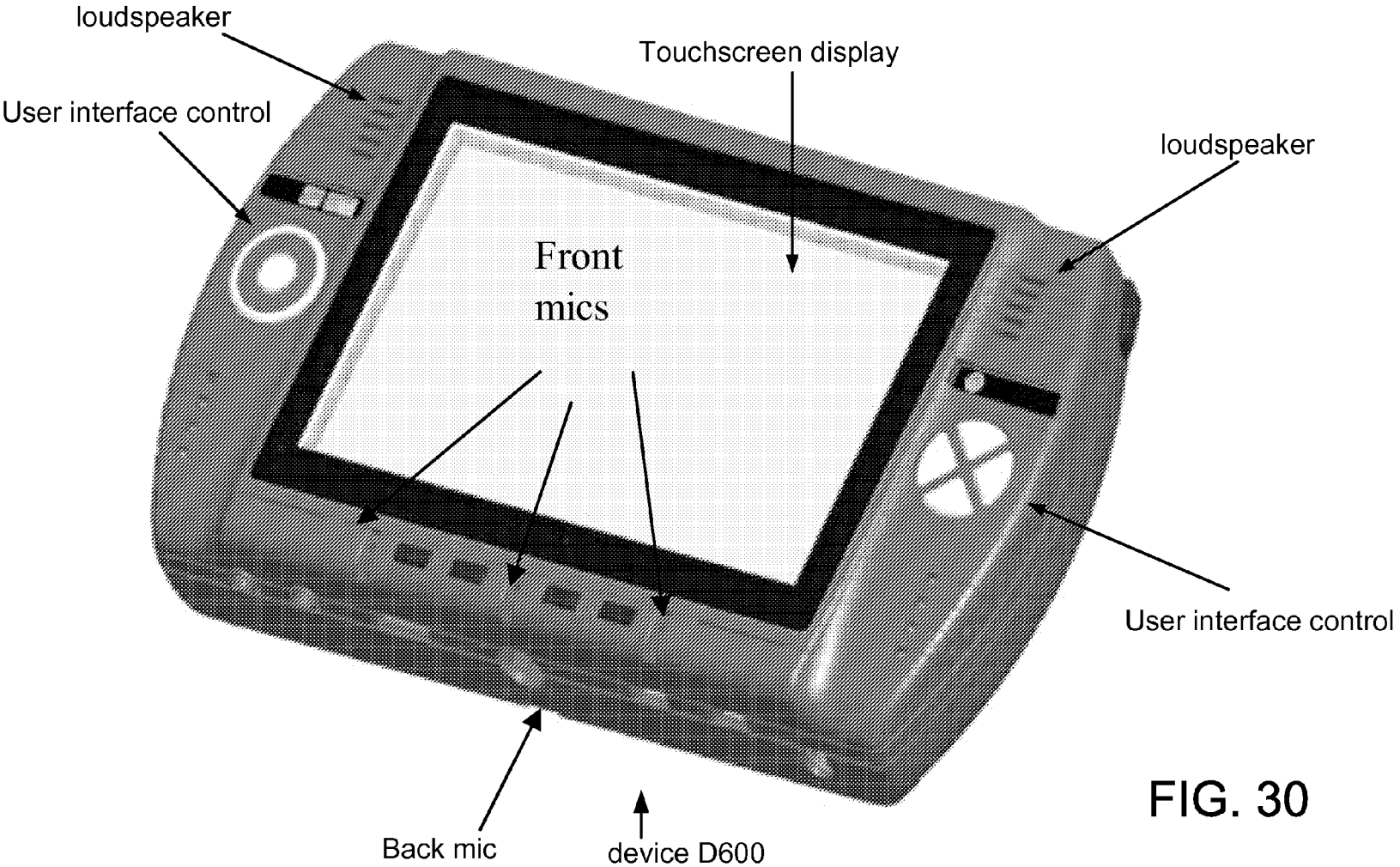
FIG. 30 shows a diagram of a multi-microphone portable audio sensing implementation D600 of device D10.

FIG. 30 shows a diagram of a multi-microphone portable audio sensing implementation D600 of device D10 for hand-held applications. Device D600 includes a touchscreen display TS10, three front microphones MC10 to MC30, a back microphone MC40, two loudspeakers SP10 and SP20, a left-side user interface control (e.g., for selection) UI10, and a right-side user interface control (e.g., for navigation) UI20. Each of the user interface controls may be implemented using one or more of pushbuttons, trackballs, click-wheels, touch-pads, joysticks and/or other pointing devices, etc. A typical size of device D800, which may be used in a browse-talk mode or a game-play mode, is about fifteen centimeters by twenty centimeters. It is expressly disclosed that applicability of systems, methods, and apparatus disclosed herein is not limited to the particular examples shown in FIGS. 25A to 30. Other examples of portable audio sensing devices to which such systems, methods, and apparatus may be applied include hearing aids.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The presentation of the configurations described herein is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, or 44 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

The various elements of an implementation of an ANC apparatus as disclosed herein may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the ANC apparatus disclosed herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a coherency detection procedure, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium, such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer storage media and communication media, including any medium that facilitates transfer of a computer program from one place to another. A storage media may be any available media that can be accessed by a computer. By way of example, and not limitation, such computer-readable media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage, magnetic disk storage or other magnetic storage devices, or any other medium that can be used to store desired program code, in the form of instructions or data structures, in tangible structures that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of processing a multichannel signal, said method comprising:

for each of a plurality of different frequency components of the multichannel signal, calculating a difference between a phase of the frequency component in a first channel of the multichannel signal and a phase of the frequency component in a second channel of the multichannel signal, to obtain a plurality of calculated phase differences;

calculating a level of the first channel and a corresponding level of the second channel;

based on the calculated level of the first channel, the calculated level of the second channel, and at least one of the plurality of calculated phase differences, calculating an updated value of a gain factor; and producing a processed multichannel signal by altering, according to the updated value, an amplitude of the second channel relative to a corresponding amplitude of the first channel, wherein each channel of the multichannel signal is based on a signal produced by a corresponding microphone, among an array of microphones, in response to an acoustic environment of the microphone.

2. The method of processing a multichannel signal according to claim 1, wherein said calculated level of the first channel is a calculated energy of the first channel in a first frequency subband, and wherein said calculated level of the second channel is a calculated energy of the second channel in the first frequency subband, and wherein said amplitude of the first channel is an amplitude of the first channel in the first frequency subband, and wherein said corresponding amplitude of the second channel is an amplitude of the second channel in the first frequency subband, and wherein said method comprises:

calculating an energy of the first channel in a second frequency subband that is different than the first frequency subband;

calculating an energy of the second channel in the second frequency subband; and based on the calculated energy of the first channel in the second frequency subband, the calculated energy of the second channel in the second frequency subband, and at least one of the plurality of calculated phase differences, calculating an updated value of a second gain factor, wherein said producing a processed multichannel signal includes producing the processed multichannel signal by altering, according to the updated value of the second gain factor, an amplitude of the second channel in the second frequency subband relative to an amplitude of the first channel in the second frequency subband.

3. The method of processing a multichannel signal according to claim 1, wherein said method comprises calculating a value of a coherency measure that indicates a degree of coherence among the directions of arrival of at least the plurality of different frequency components, based on information from the plurality of calculated phase differences; and wherein said calculating an updated value of a gain factor is based on the calculated value of the coherency measure.

4. The method of processing a multichannel signal according to claim 3, wherein said altering an amplitude of the first channel relative to a corresponding amplitude of the second channel is performed in response to a result of comparing said value of the coherency measure to a threshold value.

5. The method of processing a multichannel signal according to claim 3, wherein said method comprises, based on a relation between a level of a first channel of the processed multichannel signal and a level of a second channel of the processed multichannel signal, and in response to a result of comparing said value of the coherency measure to a threshold value, updating a noise estimate according to acoustic information from at least one of the first and second channels of the multichannel signal.

6. The method of processing a multichannel signal according to claim 1, wherein said method includes selecting the plurality of different frequency components based on an estimated pitch frequency of the multichannel signal.

7. The method of processing a multichannel signal according to claim 1, wherein said updated value of a gain factor is based on a ratio between the calculated level of the first channel and the calculated level of the second channel.

8. The method of processing a multichannel signal according to claim 1, wherein said producing a processed multichannel signal by altering, according to the updated value, an amplitude of the second channel relative to a corresponding amplitude of the first channel comprises reducing an imbalance between the calculated levels of the first and second channels.

9. The method of processing a multichannel signal according to claim 1, wherein said producing a processed multichannel signal includes altering, according to the updated value, an amplitude of the second channel relative to a corresponding amplitude of the first channel in each of a plurality of consecutive segments of the multichannel signal.

10. The method of processing a multichannel signal according to claim 1, wherein said method comprises, based on a relation between a level of a first channel of the processed multichannel signal and a level of a second channel of the processed multichannel signal, indicating the presence of voice activity.

11. The method of processing a multichannel signal according to claim 10, wherein said method comprises, based on information from said plurality of calculated phase differences, indicating that the multichannel signal is directionally coherent in an endfire direction of the array of microphones, and wherein said indicating the presence of voice activity is performed in response to said indicating that the multichannel signal is directionally coherent.

12. The method of processing a multichannel signal according to claim 1, wherein said plurality of different frequency components of the multichannel signal is within a range of acoustic frequencies.

13. The method of processing a multichannel signal according to claim 1, wherein at least one among said calculating a difference, calculating a level, calculating an updated value, and producing the processed multichannel signal is performed by a device configured to process signals having acoustic frequencies.

14. The method of processing a multichannel signal according to claim 1, wherein said processed multichannel signal represents an acoustic environment of the array of microphones.

15. The method of processing a multichannel signal according to claim 1, wherein said method comprises, based on information from the plurality of calculated phase differences, determining whether a segment of the multichannel signal is acoustically balanced.

16. The method of processing a multichannel signal according to claim 15, wherein said calculating an updated value of a gain factor is performed in response to said determining.

17. The method of processing a multichannel signal according to claim 15, wherein said method comprises, for each among a plurality of gain factors, and in response to said determining, calculating an updated value of the gain factor that is based on a corresponding one of the calculated phase differences.

18. The method of processing a multichannel signal according to claim 1, wherein said method comprises, based on information from the plurality of calculated phase differences, determining whether a subband of the multichannel signal is acoustically balanced.

19. A non-transitory computer-readable storage medium comprising tangible features that when read by a processor cause the processor to:

calculate, for each of a plurality of different frequency components of the multichannel signal, a difference between a phase of the frequency component in a first channel of the multichannel signal and a phase of the frequency component in a second channel of the multichannel signal, to obtain a plurality of calculated phase differences;

calculate a level of the first channel and a corresponding level of the second channel;

calculate an updated value of a gain factor, based on the calculated level of the first channel, the calculated level of the second channel, and at least one of the plurality of calculated phase differences; and produce a processed multichannel signal by altering, according to the updated value, an amplitude of the second channel relative to a corresponding amplitude of the first channel, wherein each channel of the multichannel signal is based on a signal produced by a corresponding microphone, among an array of microphones, in response to an acoustic environment of the microphone.

20. An apparatus for processing a multichannel signal, said apparatus comprising:

a first calculator configured to obtain a plurality of calculated phase differences by calculating, for each of a plurality of different frequency components of the multichannel signal, a difference between a phase of the frequency component in a first channel of the multichannel signal and a phase of the frequency component in a second channel of the multichannel signal;

a second calculator configured to calculate a level of the first channel and a corresponding level of the second channel;

a third calculator configured to calculate an updated value of a gain factor, based on the calculated level of the first channel, the calculated level of the second channel, and at least one of the plurality of calculated phase differences; and a gain control element configured to produce a processed multichannel signal by altering, according to the updated value, an amplitude of the second channel relative to a corresponding amplitude of the first channel, wherein at least one among said first calculator, said second calculator, said third calculator, and said gain control element is implemented by at least one processor, and wherein each channel of the multichannel signal is based on a signal produced by a corresponding microphone, among an array of microphones, in response to an acoustic environment of the microphone.

21. The apparatus according to claim 20, wherein said calculated level of the first channel is a calculated energy of the first channel in a first frequency subband, and wherein said calculated level of the second channel is a calculated energy of the second channel in the first frequency subband, and wherein said amplitude of the first channel is an amplitude of the first channel in the first frequency subband, and wherein said corresponding amplitude of the second channel is an amplitude of the second channel in the first frequency subband, and wherein said second calculator is configured to calculate an energy of the first channel in a second frequency subband that is different than the first frequency subband, and to calculate an energy of the second channel in the second frequency subband, and wherein said third calculator is configured to calculating an updated value of a second gain factor, based on the calculated energy of the first channel in the second frequency subband, the calculated energy of the second channel in the second frequency subband, and at least one of the plurality of calculated phase differences, wherein said gain control element is configured to produce the processed multichannel signal by altering, according to the updated value of the second gain factor, an amplitude of the second channel in the second frequency subband relative to an amplitude of the first channel in the second frequency subband.

22. The apparatus according to claim 20, wherein said third calculator is configured to calculate a value of a coherency measure that indicates a degree of coherence among the directions of arrival of at least the plurality of different frequency components, based on information from the plurality of calculated phase differences; and wherein said third calculator is configured to calculate the updated value of a gain factor based on the calculated value of the coherency measure.

23. The apparatus according to claim 22, wherein said third calculator is configured to compare said value of the coherency measure to a threshold value, and wherein said gain control element is configured to alter an amplitude of the first channel relative to a corresponding amplitude of the second channel in response to a result of said comparing said value of the coherency measure to a threshold value.

24. The apparatus according to claim 22, wherein said method comprises, based on a relation between a level of a first channel of the processed multichannel signal and a level of a second channel of the processed multichannel signal, and in response to a result of comparing said value of the coherency measure to a threshold value, updating a noise estimate according to acoustic information from at least one of the first and second channels of the multichannel signal.

25. The apparatus according to claim 20, wherein said phase difference calculator is configured to select the plurality of different frequency components based on an estimated pitch frequency of the multichannel signal.

26. The apparatus according to claim 20, wherein said updated value of a gain factor is based on a ratio between the calculated level of the first channel and the calculated level of the second channel.

27. The apparatus according to claim 20, wherein said gain control element is configured to reduce an imbalance between the calculated levels of the first and second channels by altering, according to the updated value, an amplitude of the second channel relative to a corresponding amplitude of the first channel.

28. The apparatus according to claim 20, wherein said gain control element is configured to produce the processed multichannel signal by altering, according to the updated value, an amplitude of the second channel relative to a corresponding amplitude of the first channel in each of a plurality of consecutive segments of the multichannel signal.

29. The apparatus according to claim 20, wherein said apparatus includes a voice activity detector configured to indicate the presence of voice activity based on a relation between a level of a first channel of the processed multichannel signal and a level of a second channel of the processed multichannel signal.

30. An apparatus for processing a multichannel signal, said apparatus comprising:

means for calculating, for each of a plurality of different frequency components of the multichannel signal, a difference between a phase of the frequency component in a first channel of the multichannel signal and a phase of the frequency component in a second channel of the multichannel signal, to obtain a plurality of calculated phase differences;

means for calculating a level of the first channel and a corresponding level of the second channel;

means for calculating an updated value of a gain factor, based on the calculated level of the first channel, the calculated level of the second channel, and at least one of the plurality of calculated phase differences; and means for producing a processed multichannel signal by altering, according to the updated value, an amplitude of the second channel relative to a corresponding amplitude of the first channel, wherein at least one among said means for calculating a difference, said means for calculating a level, said means for calculating an updated value, and said means for producing is implemented by at least one processor, and wherein each channel of the multichannel signal is based on a signal produced by a corresponding microphone, among an array of microphones, in response to an acoustic environment of the microphone.

31. The apparatus according to claim 30, wherein said calculated level of the first channel is a calculated energy of the first channel in a first frequency subband, and wherein said calculated level of the second channel is a calculated energy of the second channel in the first frequency subband, and wherein said amplitude of the first channel is an amplitude of the first channel in the first frequency subband, and wherein said corresponding amplitude of the second channel is an amplitude of the second channel in the first frequency subband, and wherein said apparatus comprises:

means for calculating an energy of the first channel in a second frequency subband that is different than the first frequency subband;

means for calculating an energy of the second channel in the second frequency subband; and means for calculating an updated value of a second gain factor, based on the calculated energy of the first channel in the second frequency subband, the calculated energy of the second channel in the second frequency subband, and at least one of the plurality of calculated phase differences, wherein said means for producing a processed multichannel signal includes means for producing the processed multichannel signal by altering, according to the updated value of the second gain factor, an amplitude of the second channel in the second frequency subband relative to an amplitude of the first channel in the second frequency subband.

32. The apparatus according to claim 30, wherein said apparatus comprises means for calculating a value of a coherency measure that indicates a degree of coherence among the directions of arrival of at least the plurality of different frequency components, based on information from the plurality of calculated phase differences; and wherein said means for calculating an updated value of a gain factor is configured to calculate the updated value of the gain factor based on the calculated value of the coherency measure.

33. The apparatus according to claim 32, wherein said means for altering an amplitude of the first channel relative to a corresponding amplitude of the second channel is configured to perform such altering in response to an output of said means for comparing said value of the coherency measure to a threshold value.

34. The apparatus according to claim 32, wherein said apparatus comprises means for updating a noise estimate according to acoustic information from at least one of the first and second channels of the multichannel signal, based on a relation between a level of a first channel of the processed multichannel signal and a level of a second channel of the processed multichannel signal, and in response to a result of comparing said value of the coherency measure to a threshold value.

35. The apparatus according to claim 30, wherein said apparatus includes means for selecting the plurality of different frequency components based on an estimated pitch frequency of the multichannel signal.

36. The apparatus according to claim 30, wherein said updated value of a gain factor is based on a ratio between the calculated level of the first channel and the calculated level of the second channel.

37. The apparatus according to claim 30, wherein said means for producing a processed multichannel signal by altering, according to the updated value, an amplitude of the second channel relative to a corresponding amplitude of the first channel is configured to reduce an imbalance between the calculated levels of the first and second channels.

38. The apparatus according to claim 30, wherein said means for producing a processed multichannel signal includes means for altering, according to the updated value, an amplitude of the second channel relative to a corresponding amplitude of the first channel in each of a plurality of consecutive segments of the multichannel signal.

39. The apparatus according to claim 30, wherein said apparatus comprises means for indicating the presence of voice activity, based on a relation between a level of a first channel of the processed multichannel signal and a level of a second channel of the processed multichannel signal.

* * * * *